US009715188B2

(12) United States Patent
Terauchi et al.

(10) Patent No.: US 9,715,188 B2
(45) Date of Patent: Jul. 25, 2017

(54) TONER

(71) Applicant: CANON KABUSHIKI KAISHA, Tokyo (JP)

(72) Inventors: Kazuo Terauchi, Numazu (JP); Koji Nishikawa, Susono (JP); Shohei Tsuda, Suntou-gun (JP); Yojiro Hotta, Mishima (JP); Katsuhisa Yamazaki, Numazu (JP); Takayuki Itakura, Mishima (JP); Takeshi Naka, Suntou-gun (JP); Motohide Shiozawa, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/890,144

(22) PCT Filed: Jul. 30, 2014

(86) PCT No.: PCT/JP2014/070656
§ 371 (c)(1),
(2) Date: Nov. 9, 2015

(87) PCT Pub. No.: WO2015/016381
PCT Pub. Date: Feb. 5, 2015

(65) Prior Publication Data

US 2016/0070192 A1 Mar. 10, 2016

(30) Foreign Application Priority Data

Jul. 31, 2013 (JP) ..... 2013-158909

(51) Int. Cl.
*G03G 9/097* (2006.01)
*G03G 9/08* (2006.01)
*G03G 9/083* (2006.01)
*G03G 9/087* (2006.01)

(52) U.S. Cl.
CPC ..... *G03G 9/09733* (2013.01); *G03G 9/081* (2013.01); *G03G 9/0819* (2013.01); *G03G 9/0827* (2013.01); *G03G 9/0833* (2013.01); *G03G 9/0835* (2013.01); *G03G 9/0836* (2013.01); *G03G 9/08711* (2013.01); *G03G 9/09716* (2013.01); *G03G 9/09725* (2013.01)

(58) Field of Classification Search
CPC ..... G03G 9/09716; G03G 9/09708; G03G 9/083; G03G 9/09733
See application file for complete search history.

(56) References Cited

U.S. PATENT DOCUMENTS 5,510,221 A * 4/1996 Matalevich ..... G03G 9/08782 430/106.2
5,641,601 A * 6/1997 Mitani ..... G03G 9/0833 430/106.2
6,017,668 A * 1/2000 Young ..... G03G 9/0825 430/106.2
6,326,114 B1 12/2001 Itakura et al.
6,495,303 B1 12/2002 Kanda et al.
6,528,222 B2 3/2003 Kohtaki et al.
6,586,147 B2 7/2003 Iida et al.
6,630,277 B2 10/2003 Naka et al.
6,664,016 B2 12/2003 Kanbayashi et al.
6,703,176 B2 3/2004 Naka et al.
6,751,424 B2 6/2004 Komatsu et al.
6,808,852 B2 10/2004 Hotta et al.
6,929,894 B2 8/2005 Sugahara et al.
7,115,349 B2 10/2006 Iida et al.
7,138,213 B2 11/2006 Itakura et al.
7,144,668 B2 12/2006 Baba et al.
7,147,980 B2 12/2006 Itakura et al.
7,229,727 B2 6/2007 Itakura et al.
7,244,539 B2 7/2007 Baba et al.
7,273,686 B2 9/2007 Onuma et al.
7,279,262 B2 10/2007 Fujikawa et al.
7,288,348 B2 10/2007 Hayami et al.
(Continued)

FOREIGN PATENT DOCUMENTS

JP 4-291353 A 10/1992
JP 8-106171 A 4/1996
(Continued)

OTHER PUBLICATIONS

English language machine translation of JP 08-286420 (Nov. 1996).*
English language machine translation of JP 2008-015248 (Jan. 2008).*
Taiwanese Office Action dated Dec. 15, 2015 in Taiwanese Application No. 103126026.
PCT International Search Report and Written Opinion of the International Searching Authority, International Application No. PCT/JP2014/070656, Mailing Date Sep. 9, 2014.
International Preliminary Report on Patentability, International Application No. PCT/JP2014/070656, Mailing Date Feb. 11, 2016.

*Primary Examiner* — Christopher Rodee
(74) *Attorney, Agent, or Firm* — Fitzpatrick, Cella, Harper & Scinto

(57) ABSTRACT

The toner comprising a toner particle containing a binder resin and a colorant, an iron oxide particle and an organic-inorganic composite fine particle, wherein the organic-inorganic composite fine particle comprises a vinyl resin particle, and inorganic fine particles which are embedded in the vinyl resin particle, and at least a part of which is exposed at surface of the organic-inorganic composite fine particle; the organic-inorganic composite fine particle has convexes derived from the inorganic fine particles, and wherein: a coverage ratio of the surface of the organic-inorganic composite fine particle with the inorganic fine particle is 20-70%; and the content of the iron oxide particle present on a surface of the toner particle is 0.1-5.0 mass % based on the mass of the toner particle.

8 Claims, 2 Drawing Sheets

(56) References Cited

U.S. PATENT DOCUMENTS

| | | | | |
|---|---|---|---|---|
| 7,288,354 | B2 | 10/2007 | Moribe et al. | |
| 7,297,455 | B2 | 11/2007 | Fujikawa et al. | |
| 7,351,509 | B2 | 4/2008 | Moribe et al. | |
| 7,361,441 | B2 | 4/2008 | Itakura et al. | |
| 7,396,626 | B2 | 7/2008 | Fujikawa et al. | |
| 7,396,629 | B2 | 7/2008 | Baba et al. | |
| 7,422,832 | B2 | 9/2008 | Ogawa et al. | |
| 7,442,478 | B2 | 10/2008 | Itakura et al. | |
| 7,455,947 | B2 | 11/2008 | Ida et al. | |
| 7,537,877 | B2 | 5/2009 | Yoshiba et al. | |
| 7,544,455 | B2 | 6/2009 | Yoshiba et al. | |
| 7,582,401 | B2 | 9/2009 | Ogawa et al. | |
| 7,611,813 | B2 | 11/2009 | Ida et al. | |
| 7,629,100 | B2 | 12/2009 | Okamoto et al. | |
| 7,638,251 | B2 | 12/2009 | Yamazaki et al. | |
| 7,700,254 | B2 | 4/2010 | Moribe et al. | |
| 7,740,998 | B2 | 6/2010 | Yamazaki et al. | |
| 7,745,089 | B2 | 6/2010 | Okubo et al. | |
| 7,816,063 | B2 | 10/2010 | Hashimoto et al. | |
| 7,855,042 | B2 | 12/2010 | Kobori et al. | |
| 7,858,283 | B2 | 12/2010 | Ishigami et al. | |
| 7,897,316 | B2 | 3/2011 | Yamazaki et al. | |
| 7,906,262 | B2 | 3/2011 | Ishigami et al. | |
| 7,927,775 | B2 | 4/2011 | Komatsu et al. | |
| 7,939,233 | B2 | 5/2011 | Inoue et al. | |
| 8,026,030 | B2 | 9/2011 | Moribe et al. | |
| 8,057,977 | B2 | 11/2011 | Moribe et al. | |
| 8,137,886 | B2 | 3/2012 | Baba et al. | |
| 8,142,972 | B2 | 3/2012 | Hotta et al. | |
| 8,288,069 | B2 | 10/2012 | Fujikawa et al. | |
| 8,323,726 | B2 | 12/2012 | Naka et al. | |
| 8,501,377 | B2 | 8/2013 | Takahashi et al. | |
| 8,512,925 | B2 | 8/2013 | Moribe et al. | |
| 8,927,188 | B2 | 1/2015 | Naka et al. | |
| 8,986,914 | B2 | 3/2015 | Fujikawa et al. | |
| 9,034,549 | B2 | 5/2015 | Shiotari et al. | |
| 9,040,216 | B2 | 5/2015 | Fukudome et al. | |
| 9,046,800 | B2 | 6/2015 | Hotta et al. | |
| 9,097,998 | B2 | 8/2015 | Yamazaki et al. | |
| 9,116,448 | B2 | 8/2015 | Terauchi et al. | |
| 9,128,400 | B2 | 9/2015 | Takahashi et al. | |
| 9,134,637 | B2 | 9/2015 | Hotta et al. | |
| 9,141,012 | B2 | 9/2015 | Moribe et al. | |
| 9,201,323 | B2 | 12/2015 | Nishikawa et al. | |
| 9,250,548 | B2 * | 2/2016 | Nomura | G03G 9/0838 |
| 9,256,148 | B2 | 2/2016 | Fujikawa et al. | |
| 9,261,804 | B2 | 2/2016 | Yamazaki et al. | |
| 9,341,970 | B2 | 5/2016 | Yoshiba et al. | |
| 2009/0246675 | A1 | 10/2009 | Nakamura et al. | |
| 2010/0028796 | A1 | 2/2010 | Nakamura et al. | |
| 2010/0183971 | A1 | 7/2010 | Fujikawa et al. | |
| 2011/0089085 | A1 | 4/2011 | Tamura et al. | |
| 2012/0214097 | A1 | 8/2012 | Naka et al. | |
| 2013/0252167 | A1 | 9/2013 | Moribe et al. | |
| 2013/0309603 | A1 | 11/2013 | Takahashi et al. | |
| 2014/0295341 | A1 | 10/2014 | Fomitchev et al. | |
| 2014/0335449 | A1 * | 11/2014 | Uratani | G03G 9/0833 430/108.3 |
| 2015/0037719 | A1 * | 2/2015 | Naka | G03G 9/0836 430/108.1 |
| 2015/0125790 | A1 | 5/2015 | Hotta et al. | |
| 2015/0220013 | A1 | 8/2015 | Nishikawa et al. | |
| 2016/0041481 | A1 | 2/2016 | Nomura et al. | |
| 2016/0041482 | A1 | 2/2016 | Terauchi et al. | |
| 2016/0041483 | A1 | 2/2016 | Nishikawa et al. | |
| 2016/0041484 | A1 | 2/2016 | Tsuda et al. | |
| 2016/0091809 | A1 | 3/2016 | Tsuda et al. | |
| 2016/0091813 | A1 | 3/2016 | Yoshiba et al. | |
| 2016/0139521 | A1 | 5/2016 | Tsuda et al. | |
| 2016/0139522 | A1 | 5/2016 | Yoshiba et al. | |
| 2016/0154331 | A1 | 6/2016 | Tanaka et al. | |
| 2016/0161874 | A1 | 6/2016 | Yamazaki et al. | |
| 2016/0202624 | A1 | 7/2016 | Nishikawa et al. | |

FOREIGN PATENT DOCUMENTS

| | | | |
|---|---|---|---|
| JP | 8-286420 | A | 11/1996 |
| JP | 2001-343782 | A | 12/2001 |
| JP | 2005-37744 | A | 2/2005 |
| JP | 2005-202131 | A | 7/2005 |
| JP | 2006-301305 | A | 11/2006 |
| JP | 2007-293043 | A | 11/2007 |
| JP | 2008015248 | A * | 1/2008 |
| JP | 2013-92748 | A | 5/2013 |
| WO | 2013/063291 | A1 | 5/2013 |

* cited by examiner

TONER

TECHNICAL FIELD

The present invention relates to a toner for use in a recording method using electrophotography, etc.

BACKGROUND ART

Recently, copying machines and printers have been used such that they are connected to a network and shared by many people to print through the network. When a printer is shared by many users, a large number of printing jobs are concentrated on a single printer. Because of this, high-speed and high reliability are required.

In addition, recently, printers have been used in various situations. Shared printers connected to a network as described above have been increasingly used, for example, in high temperature/humidity environments. Because of this, share printers are strongly required to have adaptability to high temperature/humidity environments.

Generally, to realize a toner for a high-speed operation, developability of the toner is improved by increasing the amount of an external additive. In other words, the conditions of a toner are controlled so as to easily fly. However, such a toner is vulnerable to external stress applied when the toner is stirred in a developer and when the temperature of a developer main-body increases. As a result, embedment of an external additive(s) occurs to lower durability and a toner adheres to members.

If developability is improved simply by increasing the amount of an external additive, the charge amount of toner increases with the machine time in a normal temperature and low-humidity environment (environment where an absolute content of water is low) and the problem of density reduction often occurs.

To suppress this problem, an attempt to suppress an increase in a charge amount in a normal temperature/low humidity environment has been made by adding a low-resistant particle such as a magnetic particle to a large amount of an external additive. However, if a toner is left alone in a high temperature/humidity environment, a charge amount does not quickly rise up in the beginning of a printing job and the density tends to be low.

In Patent Literature 1, a uniform chargeability is obtained by adding a magnetic particle as an external additive to silica. Owing to this, a certain effect is produced against scattering of a toner in a developer. However, if the use as mentioned above is presumed, it is difficult to satisfy an initial density after a toner is left alone in a high temperature/humidity environment and long-term stability in a high-speed printing system at the same time. Because of this, there is room for improvement.

In Patent Literature 2, a development/transfer step is stabilized by controlling the total coverage of toner-core particles with an external additive. Indeed, a certain effect is produced on predetermined toner core particles by controlling a calculated theoretical coverage. However, if the use as mentioned above is presumed, it is difficult to satisfy an initial density after a toner is left alone in a high temperature/humidity environment and long-term stability in a high-speed printing system at the same time. Because of this, there is room for improvement.

Furthermore, Patent Literatures 3 and 4 propose that long-term stability is improved by adding a spacer, thereby suppressing embedding of an external additive. Also, in this case, it is difficult to satisfy an initial density after a toner is left alone in a high temperature/humidity environment and long-term stability in a high-speed printing system at the same time. Because of this, there is room for improvement.

As mentioned above, it is required to develop a toner having an initial density satisfying quality even in a high temperature/humidity environment and having excellent durability in a high-speed printing system; however, there are a great many technical problems at present. Because of this, there is room for improvement.

CITATION LIST

Patent Literature

PTL 1: Japanese Patent Application Laid-Open No. 2005-37744

PTL 2: Japanese Patent Application Laid-Open No. 2007-293043

PTL 3: Japanese Patent Application Laid-Open No. 2005-202131

PTL 4: Japanese Patent Application Laid-Open No. 2013-92748

SUMMARY OF INVENTION

Technical Problem

The present invention is directed to providing a toner obtained by overcoming the aforementioned problems.

Further, the present invention is directed to providing a toner having a satisfactory initial density after a toner is left alone in a high temperature/humidity environment and long-term stability in a high-speed printing system, and suppressing formation of an image defect (streak) due to contamination of a member with an external additive.

Solution to Problem

According to one aspect of the present invention, there is provided a toner comprising a toner particle containing a binder resin and a colorant, an iron oxide particle and an organic-inorganic composite fine particle, wherein: the organic-inorganic composite fine particle comprises a vinyl resin particle, and inorganic fine particles which are embedded in the vinyl resin particle, and at least a part of which is exposed at surface of the organic-inorganic composite fine particles; the organic-inorganic composite fine particle has convexes derived from the inorganic fine particles, and wherein: a coverage ratio of the surface of the organic-inorganic composite fine particle with the inorganic fine particle is 20% or more and 70% or less; and the content of the iron oxide particle present on a surface of the toner particle is 0.1% by mass or more and 5.0% by mass or less based on the mass of the toner particle.

Advantageous Effects of Invention

According to the present invention, a satisfactory initial density after a toner is left alone in a high temperature/humidity environment and long-term stability in a high-speed printing system can be provided and an image defect (streak) due to contamination of a member with an external additive can be suppressed.

Further features of the present invention will become apparent from the following description of exemplary embodiments with reference to the attached drawings.

DESCRIPTION OF EMBODIMENTS

Figure 1:
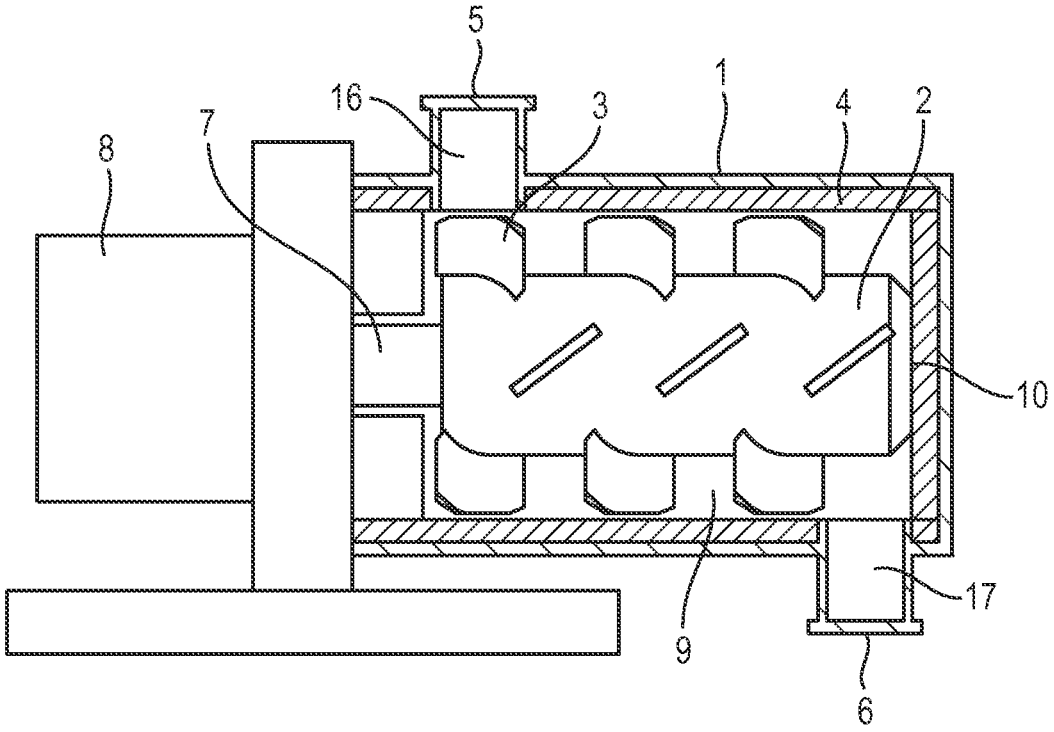
FIG. 1 is a schematic view of a mixing apparatus that can be used for mixing external additive(s).

Preferred embodiments of the present invention will now be described in detail in accordance with the accompanying drawings.

Up to now, to obtain developability and long-term stability of a toner, the quality of the image has been maintained in long term use by coating the surface of the toner by adding a large amount of an external additive. However, further stability is required for the toner used in a high-speed printing system. For example, a toner satisfactorily used in a high-speed printing system is vulnerable to external stress applied when the toner is stirred in a developer and when the temperature of a developer main-body increases. In addition, durability decreases due to embedment of an external additive and contamination of a member with an external additive tends to occur.

In the case where a large amount of an external additive is added in order to maintain a charge amount, developability is improved in normal environment (25° C., 60% RH); however, charge-up occurs in a normal temperature/low humidity environment (25° C., 10% RH) during long-time use, with the result that the problem of image density reduction occurs. Then, an attempt has been made to suppress the charge-up by adding a large amount of an external additive and increasing the adhesion of the external additive to the surface of a toner. However, if a toner is left alone in a high temperature/humidity environment, it is difficult for a charge amount to rise up and the density of an initial image tends to decrease.

The present inventors have conducted studies with the view to overcoming the above problems. As a result, we found that the above problems can be solved by using a predetermined organic-inorganic composite fine particle and an iron oxide particle.

The present invention will be outlined. The toner of the present invention contains an organic-inorganic composite fine particle and an iron oxide particle on the surface of a toner particle in order to attain developability and long-term stability even in a high-speed printing system regardless of an environment. Since the organic-inorganic composite fine particle is present, a sharp rise of charge amount is realized even after a toner is left alone in a high temperature/humidity environment, and thus a satisfactory image density can be obtained in the initiation of printing.

The toner of the present invention can be applied to a high-speed printing system and is excellent in durability, and found to successfully suppress an image defect by a member contaminated with an external additive even in the latter half of a durability test. It is characterized in that the toner of the present invention contains an organic-inorganic composite fine particle having many convexes due to inorganic fine particles b in the surface thereof. The organic-inorganic composite fine particle having many convexes is conceivably in contact with an iron oxide particle present in the surface of a toner particle as well as the surface of the toner particle at a plurality of points. Owing to the structure, even if a toner is transferred at a high speed within a developer of a high-speed printing system, triboelectric charging between toner particles frequently occurs. Because of this, it is considered that the toner is uniformly charged. As a result, it is believed that stable developability was obtained even if the toner was used for a long time.

The toner of the present invention is a toner having a toner particle containing a binder resin and a colorant, an iron oxide particle and an organic-inorganic composite fine particle, wherein: the organic-inorganic composite fine particle comprises: a vinyl resin particle, and inorganic fine particles which are embedded in the vinyl resin particle, and at least a part of which is exposed at surface of the organic-inorganic composite fine particles; the organic-inorganic composite fine particle has convexes derived from the inorganic fine particles, and wherein: a coverage ratio of the surface of the organic-inorganic composite fine particle with the inorganic fine particle is 20% or more and 70% or less.

The presence of the inorganic fine particle in the surface of an organic-inorganic composite fine particle is essential for increasing triboelectric charging between toner particles, thereby stabilizing charge regardless of an environment, as described above. In order for a toner to have a structure having such sites to be uniformly charged, an organic-inorganic composite fine particle is preferably used in view of shape control.

According to the studies conducted by the present inventors, if the coverage of the surface of an organic-inorganic composite fine particle with the inorganic fine particle is 20% or more and 70% or less and more preferably, 40% or more and 70% or less, the above effect is exerted.

If the coverage with an inorganic fine particle falls within the above range, an appropriate triboelectric charging opportunity is provided. Thus, even if a toner is left alone in a high temperature/humidity environment, satisfactory triboelectric charging can be made.

The toner of the present invention is characterized in that an iron oxide particle is present in a toner-particle surface. The amount of iron oxide particle present in a toner-particle surface is 0.1% by mass or more and 5.0% by mass or less based on the mass of the toner particle, (in other words, 0.1 part by mass or more and 5.0 parts by mass or less relative to the toner particle (100 parts by mass)). If the iron oxide particle present in the toner-particle surface falls within the above range, charge up of the toner in a normal temperature/low humidity environment can be suppressed. Owing to this, the image density in a normal temperature/low humidity environment is stabilized throughout a durability test.

If the amount of iron oxide particle present exceeds 5.0% by mass, the presence of the iron oxide particle is excessive. As a result, a member is abraded away by the iron oxide particle liberated and white streaks are often produced. In contrast, if the amount of iron oxide particle present is less than 0.1% by mass, it becomes difficult to suppress charge up of the toner in a normal temperature/low humidity environment and image density often reduces with the time of operation.

Note that the amount of iron oxide particle present in the toner-particle surface is more preferably 0.3% by mass or more and 5.0% by mass or less based on the mass of the toner particle.

In the present invention, an oxide particle (low resistant component) and an organic-inorganic composite fine particle that provides an electrical charging opportunity are present, as described above. Owing to the presence of them, the charge amount of toner can be suppressed from excessively increasing. Thus, a balance of the charge amount of toner can be maintained regardless of an environmental change.

As a shape of the iron oxide particle, an octahedron, a hexahedron, a sphere, a needle shape and a scale-like shape are mentioned. Any shape can be used; however, preferably a polyhedron, having a more complicated shape than a tetrahedron including the tetrahedron, and more preferably an octahedron is used.

The number average particle diameter (D1) of a primary iron-oxide particle is preferably 0.50 μm or less and more preferably 0.05 μm or more and 0.50 μm or less. If D1 falls within the range, it is conceivable that the iron oxide particle preferably works with the aforementioned organic-inorganic composite fine particle to produce a synergetic effect.

If the number average particle diameter (D1) of a primary iron-oxide particle is 0.10 μm or more and 0.30 μm or less, it is preferable because, in a step of externally adding the iron oxide particle, the primary iron-oxide particle is easily attached uniformly to a toner-particle surface and likely suppresses an increase in a charge amount in a normal temperature/low humidity environment. D1 is more preferably 0.10 μm or more and 0.30 μm or less.

As the iron oxide particle, for example, the following magnetic iron oxide particles can be used.

Examples of the magnetic iron oxide particles include iron oxides such as magnetite, maghemite and ferrite, metals such as iron, cobalt and nickel, alloys of these metals with a metal such as aluminium, copper, magnesium, tin, zinc, beryllium, calcium, manganese, selenium, titanium, tungsten and vanadium, and mixtures of these.

Furthermore, as magnetic properties of the above magnetic iron oxide particle under application of voltage of 79.6 kA/m, coercive force (Hc) is preferably 1.6 to 25.0 kA/m and more preferably 15.0 to 25.0 kA/m, because developability tends to increase; intensity of magnetization (σs) is preferably 30 to 90 $Am^2/kg$ and more preferably 40 to 80 $Am^2/kg$; and residual magnetization (σr) is preferably 1.0 to 10.0 $Am^2/kg$ and more preferably 1.5 to 8.0 $Am^2/kg$.

In the surface of the toner of the present invention, the organic-inorganic composite fine particle is present. The content of the organic-inorganic composite fine particle is preferably 0.2% by mass or more and 5.0% by mass or less based on the mass of the toner particle (in other words, 0.2 parts by mass or more and 5.0 parts by mass or less relative to the toner particle (100 parts by mass)) in order to obtain the synergistic effect with the iron oxide particle. If the presence ratio of the organic-inorganic composite fine particle in the toner surface falls within the above range, the toner is triboelectrically charged more frequently even if the toner is left alone in a high temperature/humidity environment and reduced in charge amount. As a result, the charge amount of toner can reach a requisite level at the same time as a printer is started up. More preferably, the content of the organic-inorganic composite fine particle is 0.2% by mass or more and 3.0% by mass or less based on the mass of the toner particle.

The organic-inorganic composite fine particle of the present invention more preferably has a shape factor of 103 or more and 120 or less. The shape factor SF-2 is measured using a photograph of an image of the organic-inorganic composite fine particle magnified 200,000 times by a transmission electron microscope.

If the shape factor SF-2 falls within the above range, many convexes due to inorganic fine particles are present in the surface of an organic-inorganic composite fine particle. As a result, the toner is triboelectrically charged more frequently even if the toner is left alone in a high temperature/humidity environment and reduced in charge amount, and consequently, the charge amount of toner can reach a requisite level at the same time as a printer is started up. The shape factor SF-2 is more preferably 105 or more and 116 or less.

It is more preferable if the organic-inorganic composite fine particle has a number average particle diameter of 70 nm or more and 500 nm or less. If the number average particle diameter falls within the above range, an organic-inorganic composite fine particle can serve as a spacer to stabilize the state of the toner surface, with the result that long-term stability can be improved. The number average particle diameter is more preferably 70 nm or more and 340 nm or less and further preferably 75 μm or more and 185 μm or less.

In the organic-inorganic composite fine particle, the THF (tetrahydrofuran) insoluble matter of a resin is more preferably 95% or more. This is because the hardness of the organic-inorganic composite fine particle increases. Because of this, the organic-inorganic composite fine particle is present in the toner surface without being deformed during a high-speed continuous operation and thus presumably the effect of the present invention can be maintained.

The organic-inorganic composite fine particle can be produced, for example, according to the description of Examples of WO 2013/063291.

The number average particle diameter and SF-2 of an organic-inorganic composite fine particle can be adjusted by changing the particle diameter of the inorganic fine particle to be used in an organic-inorganic composite fine particle and the mass ratio of an inorganic fine particle and a resin.

The inorganic fine particle to be used in organic-inorganic composite fine particle is not particularly limited; however, at least one inorganic oxide particle selected from the group consisting of silica, titanium oxide and alumina is preferable in view of adhesion to a toner surface in the present invention.

To the toner of the present invention, at least one inorganic fine particle a selected from the group consisting of silica, titanium oxide and alumina may be externally added. The number-average particle diameter (D1) of the inorganic fine particle a is 5 nm or more and 25 nm or less, and a silica fine particle is present preferably in a ratio of 85% by mass or more of the inorganic fine particle a and more preferably 90% by mass or more.

The reason why a silica fine particle is present preferably in a ratio of 85% by mass or more of the inorganic fine particle a is that a silica fine particle is most excellent in balance in view of imparting chargeability and flowability as well as excellent in reducing aggregation force between toner particles. If the aggregation force is reduced, it is preferable since triboelectric charging between toner particles frequently occurs in a high temperature/humidity environment, with the result that desired image density can be obtained.

The reason why a silica fine particle is excellent in reducing aggregation force between toner particles is not elucidated; however, since silica fine particles highly smoothly moves with each other, aggregation force is probably reduced.

The coverage A of the toner-particle surface with the inorganic fine particle a is more preferably 45.0% or more and 70.0% or less.

Provided that the coverage of a magnetic toner-particle surface with an inorganic fine particle a is represented by coverage A (%) and, the coverage with inorganic fine particle a adhered to the surface of a magnetic toner particle is represented by coverage B (%), it is more preferable that the coverage A is preferably 45.0% or more and 70.0% or less and the ratio of the coverage B to coverage A [coverage B/coverage A] is preferably 0.50 or more and 0.85 or less, since the charge amount of toner can reach a requisite level at the same time as a printer is started up, even if the toner is left alone in a high temperature/humidity environment and reduced in charge amount.

Furthermore, coverage A of a magnetic toner-particle surface with the inorganic fine particle a is more preferably 45.0% or more and 70.0% or less also since the toner can quickly fly from a developer carrier to a photoreceptor to satisfy needs for a high speed operation of a printer as mentioned above.

The coverage was obtained by observing a toner surface under a scanning electron microscope (SEM). The ratio of the surface of a toner-particle actually covered with inorganic fine particle a was obtained as a coverage. The details thereof will be described later.

The ratio of B/A is more preferably 0.50 or more and 0.85 or less. The ratio of B/A of 0.50 or more and 0.85 or less means that the inorganic fine particle a fixed to the surface of a toner is present to some extent, and inorganic fine particle a (that can be behave separately from the magnetic toner particle) is present above the fixed inorganic fine particle a.

As to a toner layer formed on a toner carrier, the toner layer is pressurized to some extent by a blade member for triboelectrically charging a toner. Since an inorganic fine particle a adhered to a toner-particle surface is present and an inorganic fine particle that can behave separately from the magnetic toner particle is present herein, the inorganic fine particle a that can freely move even in the state where a certain pressure is applied, is conceivably present in a toner surface. This is presumed because an initial rise in charging the toner can be effectively accelerated by the presence of the inorganic fine particle a capable of being made free other than an inorganic fine particle a adhered to a toner-particle surface. For the reason, it is considered that the toner of the present invention has a satisfactory initial rise of charge amount even used in a high speed printer and an image having a sufficient image density can be output.

Note that the ratio of B/A is more preferably 0.55 or more and 0.80 or less.

In the present invention, the variation coefficient of coverage A is preferably 10.0% or less. As described in the foregoing, coverage A is co-related to an ability of a toner to fly from a developer carrier to a photoreceptor, in short, developability. The coverage A variation-coefficient of 10.0% or less means that coverage A is extremely uniform between toner particles. If coverage A is more uniform, it is preferable since satisfactory developability can be expressed as mentioned above without variance between particles. Note that the above variation coefficient of the coverage A is more preferably 8.0% or less.

A technique for controlling the variation coefficient of coverage A to be 10.0% or less is not particularly limited; however, an apparatus and technique for externally adding a substance (described later) is preferably used since a metal oxide fine particle such as a silica fine particle can be uniformly dispersed on a toner-particle surface.

In the present invention, examples of a binder resin for a toner include, but not particularly limited to, a vinyl resin and a polyester resin. Resins known in the art can be used.

Specific examples thereof include styrene copolymers such as polystyrene, a styrene-propylene copolymer, a styrene-vinyl toluene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-octyl methacrylate copolymer, a styrene-butadiene copolymer, a styrene-isoprene copolymer, a styrene-maleic acid copolymer and a styrene-maleate copolymer; a polyacrylate, a polymethacrylate and poly(vinyl acetate). These can be used singly or in combinations of a plurality of types. Of them, particularly, a styrene copolymer and a polyester resin are preferable in view of e.g., developability and fixability.

In the toner of the present invention, a glass transition temperature (Tg) of a binder resin is preferably 40° C. or more to 70° C. or less. If the glass transition temperature (Tg) is 40° C. or more and 70° C. or less, storage stability and durability can be improved while maintaining satisfactory fixability.

In the toner of the present invention, a charge control agent can be added.

As a charge control agent for negative charge use, an organic metal complex and a chelate compound are effectively used. Examples thereof include monoazometal complexes; acetyl acetone metal complexes; and metal complexes of an aromatic hydroxycarboxylic acid or an aromatic dicarboxylic acid. Specific examples of a commercially available product thereof include Spilon Black TRH, T-77, T-95 (manufactured by Hodogaya Chemical Co., LTD.) and BONTRON (R)S-34, S-44, S-54, E-84, E-88, E-89 (manufactured by Orient Chemical Industries Co., Ltd).

These charge control agents can be used alone or in combination of two or more. Use amount of these charge control agents is preferably 0.1 to 10.0 parts by mass and more preferably 0.1 to 5.0 parts by mass based on the binder resin (100 parts by mass), in view of the charge amount of toner.

To the toner of the present invention, if necessary, a release agent may be blended in order to improve fixability. As the release agent, all release agents known in the art can be used. Examples thereof include petroleum waxes and derivatives thereof such as paraffin wax, microcrystalline wax and petrolatum; hydrocarbon waxes and derivatives thereof obtained by the Fischer-Tropsch method such as montan wax and derivatives thereof; polyolefin waxes and derivatives thereof represented by polyethylene and polypropylene, natural waxes and derivatives thereof such as carnauba wax and candelilla wax; and ester waxes. The derivatives herein include oxides, block copolymers with a vinyl monomer and graft-modified polymers. Examples of the ester wax that can be used include a mono-functional ester wax, a bifunctional ester wax and a polyfunctional ester wax such as a tetrafunctional wax and hexafunctional wax.

When a release agent is used in the toner of the present invention, the content of the release agent is preferably 0.5 parts by mass or more and 10 parts by mass or less based on the binder resin (100 parts by mass). If the content of the release agent falls within the above range, fixability improves and storage stability of the toner is not damaged.

Furthermore, a release agent can be blended when a resin is produced by dissolving the resin in a solvent and adding and mixing the release agent while increasing the temperature of the resin solution, followed by stirring. Alternatively, a release agent can be blended when a toner is produced by adding the release agent during a melt-kneading step.

The peak temperature of the maximum endothermic peak (hereinafter referred to as a melting point) of a release agent measured by a differential scanning calorimeter (DSC) is preferably 60° C. or more and 140° C. or less and more preferably 70° C. or more and 130° C. or less. If the peak temperature of the maximum endothermic peak (melting point) is 60° C. or more and 140° C. or less, it is preferable since the toner is easily plasticized in fixing the toner and fixability improves. In addition, even if a toner is stored for a long time, bleeding of the release agent is unlikely to occur, and thus such temperatures are preferable.

In the present invention, the peak temperature of the maximum endothermic peak of a release agent is measured by a differential scanning calorimeter "Q1000" (manufactured by TA Instruments) according to ASTM D3418-82. The temperature detected by a detection unit of the apparatus is corrected by using the melting points of indium and zinc and calorie is corrected by using heat of fusion of indium.

More specifically, a measurement sample (about 10 mg) is weighed and placed in an aluminum pan. As a reference, a blank aluminum pan is used. Measurement is performed at a measuring temperature within the range of 30 to 200° C. at a temperature increasing rate of 10° C./min. Note that, in measurement, the temperature is once increased to 200° C., subsequently reduced at a rate of 10° C./min to 30° C. and then increased again at a rate of 10° C./min. From the DSC curve in a temperature range of 30 to 200° C. obtained in the second temperature increase period, the peak temperature of the maximum endothermic peak of the release agent is obtained.

The toner of the present invention may be a single-component magnetic toner. In this case, a magnetic substance is contained in the interior portion of a toner-particle and further a magnetic iron oxide particle may be present in the toner-particle surface.

As the magnetic substance to be contained within a magnetic toner particle, an iron oxide particle as mentioned above can be used.

When the toner of the present invention is used as a single-component magnetic toner, the magnetic substance to be contained within the magnetic toner is preferably 35% by mass or more and 50% by mass or less and more preferably 40% by mass or more and 50% by mass or less.

If the content of the magnetic substance is less than 35% by mass, the magnetic attractive force to be applied to a magnetic roll within a development sleeve decreases and fogging tends to decrease. In contrast, if the content of the magnetic substance exceeds 50% by mass, developability reduces and thereby the density reduces.

A method of measuring the amount of iron oxide particle present in the toner-particle surface will be described later.

Note that in the present invention, the aforementioned magnetic properties of a magnetic substance and a magnetic iron oxide particle were measured by a vibrating magnetometer VSM P-1-10 (manufactured by TOEI INDUSTRY Co., Ltd.) at room temperature of 25° C. in an external magnetic field of 79.6 kA/m.

The primary-particle number average particle diameter (D1) of the inorganic fine particle a is preferably 5 nm or more and 50 nm or less and more preferably 10 nm or more and 35 nm or less.

It is preferable that the inorganic fine particle a is hydrophobically treatment in advance. Particularly preferably, a hydrophobic treatment is performed such that the degree of hydrophobicity measured by a methanol titration test becomes 40% or more, and more preferably 50% or more.

As the hydrophobic treatment method, for example, a treatment method with an organo-silicon compound, a silicone oil or a long-chain fatty acid is mentioned.

Examples of the organo-silicon compound include hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane and hexamethyldisiloxane. These can be used alone or as a mixture of one or two or more.

Examples of the silicone oil include a dimethylsilicone oil, a methylphenylsilicone oil, an α-methylstyrene modified silicone oil, a chlorophenyl silicone oil and a fluorine modified silicone oil.

As the long-chain fatty acid, a fatty acid having 10 to 22 carbon atoms is preferably used. The long-chain fatty acid may be a linear-chain fatty acid or a branched fatty acid. Either a saturated fatty acid or an unsaturated fatty acid can be used.

Of them, a linear saturated fatty acid having 10 to 22 carbon atoms is extremely preferable since the surface of an inorganic fine particle can be uniformly treated.

Examples of the linear saturated fatty acid include capric acid, lauric acid, myristic acid, palmitic acid, stearic acid, arachic acid and behenic acid.

Inorganic fine particle a treated with a silicone oil is preferable, and inorganic fine particle a treated with an organo-silicon compound and a silicone oil is more preferable. This is because the degree of hydrophobicity can be preferably controlled.

As a method for treating the inorganic fine particle a with silicone oil, for example, a method of directly adding inorganic fine particle a treated with an organo-silicon compound to a silicone oil and mixing them by a mixer such as a Henschel mixer, and a method of spraying silicone oil to inorganic fine particle a are mentioned. Alternatively, a method of dissolving or dispersing a silicone oil in an appropriate solvent, thereafter adding an inorganic fine particle a thereto, mixing it and removing the solvent may be mentioned.

To obtain satisfactory hydrophobicity, the amount of silicone oil for treatment is preferably 1 part by mass or more and 40 parts by mass or less relative to the inorganic fine particle a (100 parts by mass), and more preferably 3 parts by mass or more and 35 parts by mass or less.

The silica fine particle, titania fine particle and alumina fine particle to be used in the present invention preferably has a specific surface area (BET specific surface area, measured by BET method based on nitrogen adsorption) of 20 $m^2/g$ or more and 350 $m^2/g$ or less and more preferably 25 $m^2/g$ or more and 300 $m^2/g$ or less, in order to obtain satisfactory flowability of a toner.

The specific surface area (BET specific surface area, measured by the BET method based on nitrogen adsorption) is measured according to JIS Z 8830 (2001). As the measurement apparatus, an "automatic specific surface area/fine pore distribution measurement apparatus, TriStar 3000 (manufactured by Shimadzu Corporation)" employing a gas adsorption method (based on a constant volume method) as the measurement system, is used.

Herein, the addition amount of an inorganic fine particle a, is preferably 1.5 parts by mass or more and 3.0 parts by mass or less relative to the toner particle (100 parts by mass), more preferably 1.5 parts by mass or more and 2.6 parts by mass or less, and further preferably 1.8 parts by mass or more and 2.6 parts by mass or less.

If the addition amount of an inorganic fine particle a falls within the above range, coverage A and B/A are properly controlled. Further the addition amount within the above range is preferable in view of image density and fogging.

To the toner of the present invention, a particle having a primary-particle number average particle diameter (D1) of 80 nm or more to 3 μm or less may be added in addition to the inorganic fine particle a mentioned above. For example, a lubricant such as a fluorine resin powder, a zinc stearate powder and a polyvinylidene fluoride powder; a polishing agent such as a cerium oxide powder, a silicon carbide powder and a strontium titanate powder; a spacer particle such as silica and a resin particle can be used in such a small amount that does not influence the effect of the present invention.

The toner of the present invention has a weight average particle diameter (D4) of preferably 6.0 μm or more and 10.0 μm or less and more preferably 7.0 μm or more to 9.0 μm or less, in view of balance between developability and fixability.

Now, the production method for the toner of the present invention will be described by way of examples; however the method is not limited to these examples.

The toner of the present invention can be produced by a production method known in the art. The production method is not particularly limited as long as coverage A and B/A are adjusted by the method (in other words, production steps other than the step are not particularly limited).

As the production method, the following methods are preferably mentioned. First, a binder resin and a colorant, or a magnetic substance, and, if necessary, other materials such as wax and a charge control agent, are sufficiently mixed by a mixer such as a Henschel mixer or a ball mill, melted, mixed and kneaded by a heat kneader such as a roll, a kneader and extruder. In this way, resins are mutually melted with each other.

After the obtained melt-kneaded product is cooled to solidify, the resultant product is subjected to rough grinding, fine grinding and classification. To the obtained toner particle, an external additives such as an organic-inorganic composite fine particle, an inorganic fine particle a, and an iron oxide particle is externally added to obtain a toner.

Examples of the mixer include a Henschel mixer (manufactured by NIPPON COKE & ENGINEERING Co., Ltd.); a super mixer (manufactured by KAWATA MFG Co., Ltd.); Ribocone (manufactured by OKAWARA CORPORATION); a nauter mixer, a turbulizer, a cyclone mix (manufactured by Hosokawa Micron Corporation); a spiral pin mixer (manufactured by Pacific Machinery & Engineering Co., Ltd); LODIGE Mixer (manufactured by MATSUBO Corporation); and Nobilta (manufactured by Hosokawa Micron Corporation).

Examples of the kneader include a KRC kneader (manufactured by KURIMOTO LTD.); Buss co-kneader (manufactured by Buss); a TEM extruder (manufactured by TOSHIBA MACHINE CO., LTD); a TEX twin-screw kneader (manufactured by The Japan Steel Works, LTD.); a PCM kneader (manufactured by Ikegai Tekkosho); a three-roll mill, a mixing roll mill, a kneader (manufactured by INOUE MANUFACTURING Co., Ltd.); Kneadex (manufactured by NIPPON COKE & ENGINEERING Co., Ltd.); MS pressure kneader, Kneader ruder (manufactured by Moriyama Manufacturing Co., Ltd.); and a Banbury mixer (manufactured by KOBE STEEL LTD.).

Examples of the grinder include a counter jet mill, a micron jet, an ionmizer (manufactured by Hosokawa Micron Group); an IDS mill and a PJM jet grinder (manufactured by NIPPON PNEUMATIC MFG. CO., LTD.); a cross jet mill (manufactured by KURIMOTO LTD.); Urmax (manufactured by NISSO ENGINEERING CO., LTD.); SK jet O mill (manufactured by SEISHIN ENTERPRISE Co., Ltd.); Cryptron (manufactured by Kawasaki Heavy Industries, Ltd.); a turbo mill (manufactured by Turbe Corporation); and a super rotor (Nisshin Engineering Inc.).

Of them, a turbo mill is used to successfully control the average degree of circularity by adjusting the exhaust temperature during micro-grinding. If the exhaust temperature is adjusted to be low (e.g., 40° C. or less), the average degree of circularity decreases. Whereas, if the exhaust temperature is adjusted to be high (e.g., around 50° C.), the average degree of circularity increases.

Examples of the classifier include Classsiel, Micron classifier, Spedic classifier (manufactured by SEISHIN ENTERPRISE Co., Ltd.); Turbo classifier (manufactured by Nisshin Engineering Inc.); a micron separator, a turbo plex (ATP), TSP separator (manufactured by manufactured by Hosokawa Micron Group); Elbow jet (manufactured by Nittetsu Mining Co., Ltd.), a dispersion separator (manufactured by NIPPON PNEUMATIC MFG. CO., LTD.); and YM microcut (manufactured by Yasukawa Corporation).

Examples of a sieve shaker for use in sieving crude particles, etc. include Ultrasonic (manufactured by Koei Sangyo Co., Ltd.); Rezona Sieve, Gyro shifter (manufactured by TOKUJU CORPORATION); Vibrasonic system (manufactured by DALTON Co., Ltd.); Soniclean (manufactured by SINTOKOGIO, LTD.); Turbo screener (manufactured by Turbo Kogyosha); Micro shifter (manufactured by Makino mfg co., Ltd.); and a circular sieve shaker.

Examples of a mixing apparatus for externally adding an inorganic fine particle a, the aforementioned mixing apparatuses known in the art can be used; however, the apparatus shown in FIG. 1 is preferable in order to easily control coverage A, B/A and the variation coefficient of coverage A. This apparatus is also preferable as a mixing apparatus for externally adding an iron oxide particle.

FIG. 1 is a schematic view illustrating a mixing apparatus that can be used for externally adding the inorganic fine particle a to be used in the present invention. The mixing apparatus is constituted such that shear is applied to a toner particle and an inorganic fine particle a in a narrow clearance. Because of this, it is easy to adhere the inorganic fine particle a to the surface of a toner particle.

Now, measurement methods for physical properties of the present invention will be described below.

Since a magnetic toner is used in Examples of the present invention, a method of measuring physical properties of the magnetic toner will be described below.

<Quantification Method for Organic-Inorganic Composite Fine Particle and Iron Oxide Particle>

When the content of an organic-inorganic composite fine particle and an iron oxide particle in a magnetic toner containing a plurality of external additives (additives externally added to the magnetic toner particle) is measured, it is necessary to separate the magnetic toner particle and external additives and further separate and collect the particles whose content is to be measured from the external additives separated.

As a specific method, for example, the following methods are mentioned.

(1) A magnetic toner (5 g) is placed in a sample vial. Methanol (200 mL) is added and further several drops of "Contaminon N" (a 10 mass % aqueous solution of a neutral detergent for washing a precision measuring apparatus, containing a nonionic surfactant, an anionic surfactant and an organic builder, pH7, manufactured by Wako Pure Chemical Industries Ltd.) are added.

(2) The sample is dispersed by an ultrasonic cleaner for 5 minutes to separate external additives.

(3) The mixture is filtered under aspiration (10 μm membrane filter) to separate magnetic toner particles and external additives.

(4) The above steps (2) and (3) are repeated three times in total.

By the above operation, the external additives are isolated from the magnetic toner particles. The aqueous solution is recovered and centrifuged to separate and collect organic-inorganic composite fine particles and iron oxide particles. Subsequently, the solvent is removed and the resultant particles are sufficiently dried by a vacuum dryer. The mass of the particles is measured to obtain the content of the organic-inorganic composite fine particles and the iron oxide particles.

<Quantification Method for Inorganic Fine Particle a>

(1) Quantification of the Content of Silica Fine Particles in Magnetic Toner (Standard Addition Method)

A magnetic toner (3 g) is placed in an aluminum ring having a diameter of 30 mm and a pressure of 10 tons is applied to prepare pellets. The intensity of silicon (Si) (Si intensity-1) is obtained by wavelength dispersion X-ray fluorescence analysis (XRF). Note that any measurement conditions may be used as long as they are optimized according to the XRF apparatus to be used; however, a series of intensity measurements shall be performed all in the same conditions. To the magnetic toner, a silica fine particle having a primary-particle number average particle diameter of 12 nm (1.0 mass % relative to the magnetic toner) is added and mixed by a coffee mill.

At this time, any silica fine particles can be mixed as long as they have a primary-particle number average particle diameter within 5 nm or more and 50 nm or less, without affecting the quantification.

After mixing, the silica fine particles are pelletized in the same manner as above and the intensity of Si is obtained in the same manner as above (Si intensity-2). The same operation is repeated with respect to samples obtained by adding and mixing a silica fine particle (2.0 mass % and 3.0 mass % relative to the magnetic toner) in the magnetic toner to obtain the intensity of Si (Si intensity-3, Si intensity-4). Using Si intensity-1 to -4, the silica content (mass %) in the magnetic toner is calculated by the standard addition method. Note that if a plurality of types of silica particles serving as inorganic oxide fine particle are added, a plurality of Si intensity values are detected by XRF. Thus, in the measurement method of the invention only one type of silica particle must be used.

The titania content (mass %) and alumina content (mass %) in the magnetic toner are obtained by quantification according to the standard addition method in the same manner as in the above quantification of silica content. More specifically, the titania content (mass %) is determined by adding a titania fine particle having a primary-particle number average particle diameter of 5 nm or more and 50 nm or less, mixing them and obtaining the intensity of titanium (Ti). The alumina content (mass %) is determined by adding an alumina fine particle having a primary-particle number average particle diameter of 5 nm or more and 50 nm or less, mixing them and obtaining the intensity of aluminum (Al).

(2) Separation of Inorganic Fine Particle a from Magnetic Toner Particle

A magnetic toner (5 g) is weighed in a 200 mL polycup with a cap by a precise weighing machine. To this, methanol (100 mL) is added. The mixture is dispersed by an ultrasonic disperser for 5 minutes. While the magnetic toner is attracted by a neodymium magnet, the supernatant is discarded. The operation of dispersing with methanol and discarding the supernatant is repeated three times, and thereafter 10% NaOH (100 mL) and several drops of "Contaminon N" (a 10 mass % aqueous solution of a neutral detergent for washing a precision measuring apparatus, containing a nonionic surfactant, an anionic surfactant and an organic builder, pH7, manufactured by Wako Pure Chemical Industries Ltd.) are added and gently mixed. The resultant mixture is allowed to stand still for 24 hours. Thereafter, the mixture is separated again by use of a neodymium magnet. At this time, it should be noted that the mixture is repeatedly rinsed with distilled water so as not to leave NaOH. The particles recovered are sufficiently dried by a vacuum dryer to obtain particle A. The silica fine particles externally added are dissolved and removed by the above operation. Since the titania fine particles and alumina fine particles are hardly dissolved in a 10% NaOH, they can remain without being dissolved. If a toner has silica fine particles and other external additives, the aqueous solution from which externally added silica fine particle are removed is centrifuged and fractionated based on the difference in specific gravity. The solvent is removed from the individual fractions and the resultant fractions are sufficiently dried by a vacuum dryer and subjected to measurement of weight. In this manner, the contents of individual types of particles can be obtained.

(3) Measurement of Si Intensity in Particle A

Particle A (3 g) is placed in an aluminum ring having a diameter of 30 mm and a pressure of 10 tons is applied to prepare pellets. The intensity of Si (Si intensity-5) is obtained wavelength dispersion X-ray fluorescence analysis (XRF). Using Si intensity-5 and Si intensity-1 to 4 used in determining the silica content in the magnetic toner to calculate the silica content (mass %) in particle A.

(4) Separation of Magnetic Substance from Magnetic Toner

To particle A (5 g), tetrahydrofuran (100 mL) is added. After the solution is sufficiently mixed and then subjected to ultrasonic dispersion for 10 minutes. While the magnetic particles are attracted by a magnet, the supernatant is discarded. The operation is repeated five times to obtain particle B. Organic components such as a resin other than the magnetic substance can be substantially removed by the operation. However, there is a possibility for tetrahydrofuran insoluble matter to remain. Therefore, it is necessary to heat particle B obtained in the aforementioned operation up to 800° C. to burn the remaining organic components. Particle C obtained after heating can be regarded as the magnetic substance contained in the magnetic toner particle.

The mass of particle C can be measured to obtain magnetic-substance content W (mass %) in the magnetic toner. At this time, to correct an increase by oxidation in the content of the magnetic substance, the mass of particle C is multiplied by 0.9666 ($Fe_2O_3 \rightarrow Fe_3O_4$). Note that the content of the magnetic substance in a magnetic toner can be obtained by this method.

In short, $$\text{Magnetic-substance content } W \text{ (mass \%)} = ((\text{mass of particle } A \text{ recovered from toner (5 g)})/5) \times (0.9666 \times (\text{mass of particle } C)/5) \times 100.$$

(5) Measurement of Ti Intensity and Al Intensity in Magnetic Substance Separated.

The contents of titania and alumina contained as impurities or additives in the magnetic substance are calculated by converting the intensity of Ti and Al detected into titania and alumina, respectively based on the FP quantification method of wavelength dispersion X-ray fluorescence analysis (XRF).

The quantification values obtained by the above technique are assigned to the following expression to calculate the amount of externally added silica fine particles, the amount of externally added titania fine particles and the amount of externally added alumina fine particles. Note that in the computation expression, the amount of silica, titania and alumina is ignored since the amount of them externally added to an iron oxide particle is extremely low. If an iron oxide particle having a large content of these components is used, the magnetic substance is separated by the method mentioned above and the content of these components is quantitatively obtained, and the value of the content may be subtracted.

Amount of externally added silica fine particles (mass %)=silica content (mass %) in magnetic toner−silica content (mass %) in particle *A*

Amount of externally added titania fine particles (mass %)=titania content (mass %) in magnetic toner−{titania content (mass %) in magnetic substance×magnetic-substance content *W* (mass %)/100}

Amount of externally added alumina fine particles (mass %)=alumina content (mass %) in magnetic toner−{alumina content (mass %) in magnetic substance×magnetic-substance content *W* (mass %)/100}

(6) Calculation of proportion of silica fine particle in metal oxide fine particle selected from the group consisting of a silica fine particle, a titania fine particle and alumina fine particle, in an inorganic oxide fine particle adhered to the surface of a magnetic toner particle.

If a toner particle is a non-magnetic particle, the content of an external additive can be measured by a method using difference in specific gravity of toner particles among the aforementioned measurement methods. If e.g., centrifugal separation is used in place of discarding the supernatant while a magnetic toner is attracted by a neodymium magnet, they can be separated based on difference in specific gravity.

In the calculation method (described later) for coverage B, after an operation of "removing an unadhered inorganic oxide fine particle", the toner was dried and then subjected to the same operation as in the above methods (1) to (5). In this manner, the proportion of the silica fine particle in the metal oxide fine particle can be calculated.

<Method for Determining Primary-Particle Number Average Particle Diameter of Inorganic Fine Particle a>

The primary-particle number average particle diameter of an inorganic fine particle a can be calculated based on the image of inorganic fine particles on a magnetic-toner surface photographed by a Hitachi ultrahigh resolution field-emission scanning electron microscope S-4800 (manufactured by Hitachi High-Technologies Corporation). The image-taking conditions by S-4800 are as follows.

Operations of the methods (1) to (3) are performed in the same manner as in the "Calculation of coverage A" (described later). Similarly to (4), a camera is brought into focus on a magnetic-toner surface at 50000 fold magnification and brightness is adjusted in an ABC mode. Thereafter, magnification is changed to 100000 fold and then focus is brought into the magnetic-toner in the same manner as in (4) by use of a focus knob and a STIGMA/ALIGNMENT knob and then an autofocus system is used to bring focus. The focusing operation is repeated again at 100000 fold magnification.

Thereafter, particle diameters of at least 300 inorganic fine particles a on the magnetic-toner surface are measured to obtain a number-average particle diameter (D1). Since inorganic fine particles a are sometimes present as aggregates herein, the maximum diameters of particles which can confirmed as primary particles are measured and the obtained maximum diameters are arithmetically averaged to obtain the primary-particle number average particle diameter (D1).

<Calculation of Coverage A>

In the present invention, coverage A is calculated by analyzing the magnetic-toner surface image, which is photographed by a Hitachi ultrahigh resolution field-emission scanning electron microscope S-4800 (manufactured by Hitachi High-Technologies Corporation), by use of image analysis software Image-Pro Plus ver.5.0 (Nippon Roper K.K.). The image taking conditions by S-4800 are as follows.

(1) Sample Preparation

A conductive paste is thinly applied to a sample stand (aluminum sample stand: 15 mm×6 mm) and a magnetic toner is sprayed on the conductive paste. Excessive magnetic toner is removed from the sample stand by air blow and the sample stand is sufficiently dried. The sample stand is set to a sample holder and the height of the sample stand is adjusted to a level of 36 mm by use of a sample height gauge.

(2) Setting Observation Conditions of S-4800

Coverage A is calculated based on a reflection electron image observed under S-4800. Since the charge-up of the reflection electron image of inorganic fine particles a is lower than that of a secondary electron image, coverage A can be accurately measured.

In an anti-contamination trap equipped to a microscope body of S-4800, liquid nitrogen is injected until it spills over and allowed to stand still for 30 minutes. "PC-SEM" of S-4800 is started up and an FE tip (electronic source) is flashed and cleaned. In the window, acceleration voltage displayed on the control panel is clicked and the [Flashing] button is pressed to open a flash-execution dialog. After the intensity level of flashing is confirmed to be 2 and executed. Then, the emission current by flashing is confirmed to be 20 to 40 μA. A sample holder is inserted into a sample chamber of the S-4800 microscope body. A button [HOME] on the control panel is pressed to move the sample holder to a viewing position.

The "acceleration voltage" display is clicked to open the HV setting dialog. The acceleration voltage is set at [0.8 kV] and the emission current is set at [20 μA]. In the [SEM] tab of the operation panel, the signal section is set at [SE] and the SE detector is set at [Upper (U)] and [+BSE] is selected. In the selection box at the right side of [+BSE], [L.A.100] is selected to set a mode of observing a reflection electron image. In the same [SEM] tab on the operation panel, the probe current in the block of electronic optical condition is set at [Normal], the focal mode at [UHR] and WD at [3.0 mm]. In the acceleration voltage display on the control panel, button [ON] is pressed to apply the acceleration voltage.

(3) Calculation of Number-Average Particle Diameter (D1) of Magnetic Toner

In the "magnification" display on the control panel, magnification is set at 5000 (5 k) fold by dragging the mouse. On the operation panel, the focus knob [COARSE] is turned to roughly bring a focus on a sample and then aperture alignment is adjusted. On the control panel, [Align] is clicked to display the alignment dialog and then, [Beam] is selected. STIGMA/ALIGNMENT knobs (X, Y) on the operation panel are turned to move the beam displayed there to the center of concentric circles. Next, [Aperture] is selected and STIGMA/ALIGNMENT knobs (X, Y) are turned one by one to stop or minimize the movement of an image. The aperture dialog is closed and a focus is automatically brought on the sample. This operation is repeated further twice to bring a focus on the sample.

Thereafter, the diameters of 300 magnetic toner particles are measured to obtain a number-average particle diameter (D1). Note that the particle diameter of each magnetic toner particle is specified as the maximum diameter of the magnetic toner particle observed.

(4) Focusing

The particle obtained in (3) and having a number-average particle diameter (D1) of ±0.1 μm is placed such that the middle point of the maximum diameter is aligned with the center of the measurement screen. In this state, a mouse is dragged in the magnification display of the control panel to set magnification at 10000 (10 k) fold. Then, a focus knob [COARSE] on the operation panel is turned to roughly bring a focus on the sample. Then, aperture alignment is adjusted. On the control panel, [Align] is clicked to display the alignment dialog. Then, [beam] is selected. On the operation panel, when STIGMA/ALIGNMENT knobs (X, Y) are turned to move the beam displayed there to the center of concentric circles. Next, [Aperture] is selected and STIGMA/ALIGNMENT knobs (X, Y) are turned one by one to stop or minimize the movement of an image. The aperture dialog is closed and automatically bring a focus on the image. Thereafter, magnification is set at 50000 (50 k) fold, a focus is brought on the image by using the focus knob and STIGMA/ALIGNMENT knob in the same manner as above and a focus is again automatically brought on the sample. This operation is repeated again to bring a focus on the sample. Herein, if the inclination angle of an observation surface is large, measurement accuracy for obtaining coverage is likely to decrease. Accordingly, in focusing, a sample whose surface has a low inclination angle is selected by selecting a sample on the entire surface of which comes into focus at the same time and used for analysis.

(5) Image Storage

Brightness is controlled in an ABC mode and an image having a size of 640×480 pixels is taken and stored. This image file is subjected to the following analysis. A single picture is taken per magnetic toner particle and images of at least 30 magnetic toner particles are obtained.

(6) Image Analysis

In the present invention, the images obtained by the technique described above are subjected to binarization using the following analysis software to calculate coverage A. In analysis, the picture plane obtained above is split into 12 squares and individual squares are analyzed. However, if an inorganic fine particle a having a particle diameter of 50 nm or more is seen in a sprit square section, calculation of coverage A shall not be performed in this section.

The analysis conditions for image analysis software Image-Pro Plus ver. 5.0 are as follows:

Software Image-Pro Plus 5.1J

The "Measure" of the toolbar is opened and then "Count/Size" and then "Options" are selected to set binarization conditions. In the object extraction options, 8-Connect is checked and Smoothing is set at 0. Others, i.e., "Pre-Filter", "Fill Holes", "Convex Hull" are unchecked, and "Clean Borders" is set at "None". In "Measure" of the toolbar, "Select Measurements" are selected and 2 to $10^7$ is input in Filter Ranges of Area.

Coverage is calculated by encircling a square region. The area (C) of the region is set so as to have 24000 to 26000 pixels. Then, "Process"-binarization is selected to perform automatic binarization. The total area (D) of the regions in which silica is not present is calculated.

Based on the area C of a square region, the total area D of the regions in which silica is not present, coverage a is obtained according to the following expression:

$$\text{Coverage } a\ (\%)=100-C/D\times 100$$

As described above, coverage a is calculated with respect to 30 magnetic toner particles or more. An average value of all data obtained is regarded as coverage A in the present invention.

<Variation Coefficient of Coverage A>

The variation coefficient of coverage A is obtained as follows. Provided that the standard deviation of all coverage data used in the aforementioned coverage A calculation is represented by σ(A), the variation coefficient of coverage A can be obtained according to the following expression:

$$\text{Variation coefficient } (\%)=\{\sigma(A)/A\}\times 100$$

<Calculation of Coverage B>

Coverage B is calculated by first removing unadhered inorganic fine particle a on a magnetic-toner surface and then repeating the same operation as in calculation of coverage A.

(1) Removal of Unadhered Inorganic Fine Particle a

Unadhered inorganic fine particles a are removed as follows. In order to sufficiently remove particles except inorganic fine particle a embedded in the surface of toner particles, the present inventors studied and determined the removal conditions.

More specifically, water (16.0 g) and Contaminon N (neutral detergent, Product No. 037-10361, manufactured by Wako Pure Chemical Industries Ltd.) (4.0 g) are placed in a 30 mL glass vial and sufficiently mixed. To the solution thus prepared, a magnetic toner (1.50 g) is added and allowed to totally precipitate by applying a magnet close to the bottom surface. Thereafter, air bubbles are removed by moving the magnet; at the same time, the magnetic toner is allowed to settle in the solution.

An ultrasonic vibrator UH-50 (titanium alloy tip having a tip diameter of φ6 mm is used, manufactured by SMT Co., Ltd.) is set such that the tip comes to the center of the vial and at a height of 5 mm from the bottom surface of the vial. Inorganic fine particles a are removed by ultrasonic dispersion. After ultrasonic wave is applied for 30 minutes, the whole amount of magnetic toner is taken out and dried. At this time, application of heat is avoided as much as possible. Vacuum dry is performed at 30° C. or less.

(2) Calculation of Coverage B

Coverage of the magnetic toner after dried is calculated in the same manner as in coverage A as mentioned above to obtain coverage B.

<Weight Average Particle Diameter (D4) of Magnetic Toner and Grain Size Distribution Measurement Method>

The weight average particle diameter (D4) of a magnetic toner is calculated as follows. As a measurement apparatus, a precise grain size distribution measurement apparatus "Coulter•counter Multisizer 3" (registered trade mark, manufactured by Beckman Coulter, Inc.) equipped with a 100 μm-aperture tube and based on the pore electrical resistance method. The accompanying dedicated software "Beckman Coulter Multisizer 3 Version 3.51" (manufactured by Beckman Coulter, Inc.) is used for setting measurement conditions and analysis of measurement data. Note that, effective measurement channels; i.e., 25000 channels are used for measurement.

An aqueous electrolyte for use in measurement is prepared by dissolving special-grade sodium chloride in ion exchange water in a concentration of about 1 mass %. For example, "ISOTON II" (manufactured by Beckman Coulter, Inc.) can be used.

Note that, before measurement and analysis, the dedicated software is set as follows.

In the window "Changing Standard Operating Method (SOM)" of the dedicated software, the total count number in the control mode is set at 50000 particles; "measurement times" is set at 1; and a value obtained by using "Standard Particles 10.0 μm" (manufactured by Beckman Coulter, Inc.) is set at as a Kd value. The "Threshold/Measure Noise Level button" is pressed to automatically set threshold and noise level.

Furthermore, the current is set at 1600 μA; the gain is set at 2, the electrolytic solution is set at ISOTON II; and the "Flush Aperture Tube after each run" box is checked.

In the window "Convert Pulses to Size" of the dedicated software, the bin interval is set at logarithmic particle diameter; the particle diameter bin is set at 256 particle diameter bin; and the particle diameter range is set at 2 μm to 60 μm.

The measurement method is more specifically as follows:

(1) To a 250-mL round-bottom glass beaker for exclusive use for Multisizer 3, the aqueous electrolyte (about 200 mL) is added. The beaker is set in a sample stand, stirred counterclockwise with a stirrer rod at a rate of 24 rotations/second. The smudge and air bubbles of an aperture tube are removed in advance by the "Flush Aperture" function of the dedicated software.

(2) To a 100 mL flat-bottom glass beaker, the aqueous electrolyte about (30 mL) is added. To the beaker, a diluted solution (about 0.3 mL) of "Contaminon N" (a 10 mass % aqueous solution of a neutral detergent for washing a precision measuring apparatus, containing a nonionic surfactant, an anionic surfactant and an organic builder, pH7, manufactured by Wako Pure Chemical Industries Ltd.) prepared by diluting with ion exchange water to about three mass fold, is added.

(3) An ultrasonic disperser "Ultrasonic Dispersion System Tetora 150" (manufactured by Nikkaki Bios Co., Ltd) having an electric power of 120 W with two oscillators having an oscillatory frequency of 50 kHz installed therein so as to have a phase difference of 180°, is prepared. About 3.3 L of ion exchange water is added to the water vessel of the ultrasonic disperser, and Contaminon N (about 2 mL) is added to the water vessel.

(4) The beaker (2) is set in a beaker-immobilization hole of the ultrasonic disperser, and then the ultrasonic disperser is driven. Then, the height of the beaker is adjusted such that the resonant state of the liquid surface of the aqueous electrolyte in the beaker reaches a maximum.

(5) While the aqueous electrolyte in the beaker (4) is irradiated with ultrasonic wave, a toner (about 10 mg) is added to the aqueous electrolyte little by little and dispersed. The dispersion treatment with ultrasonic wave is further continued for 60 seconds. Note that in the ultrasonic dispersion, the temperature of water in the water vessel is appropriately adjusted so as to fall within the range of 10° C. or more and 40° C. or less.

(6) To the round-bottom beaker (1) set in the sample stand, the aqueous electrolyte (5) in which the toner is dispersed is added dropwise by use of a pipette. In this manner, the measurement concentration is adjusted to be about 5%. Measurement is performed until the number of measured particles reaches 50000.

(7) Measurement data is analyzed by dedicated software attached to the apparatus to calculate a weight average particle diameter (D4). Note that when graph/volume % is set in the dedicated software, "average diameter" displayed in the window "Analyze/Volume Statistics (Arithmetic)" is the weight average particle diameter (D4).

<Method of Measuring Number Average Particle Diameters of Iron Oxide Particle, an Organic-Inorganic Composite Fine Particle, and an Organic Fine Particle>

The number average particle diameters of the above particles (external additive) externally added to the surface of a toner is determined by use of a scanning electron microscope "S-4800" (trade name; manufactured by Hitachi, Ltd.). A toner to which the external additive is externally added is observed at a magnification of at most 200,000 fold, and major axes of 100 primary particles of the external additive are measured to obtain the number-average particle diameter. The observation magnification is appropriately adjusted depending upon the particle size of the external additive.

<Measurement Method for THF-Insoluble Matter of a Resin of Organic-Inorganic Composite Fine Particle>

THF-insoluble matter of a resin of organic-inorganic composite fine particle was quantified as follows: Organic-inorganic composite particles (about 0.1 g) are accurately weighed (Wc [g]) and placed in a centrifugation vial (for example, trade name "Oak Ridge centrifuge tube 3119-0050" (size 28.8×106.7 mm), manufactured by Nalgene) previously weighed. To the centrifugation vial, THF (20 g) is added and the centrifugation vial is allowed to stand still at room temperature for 24 hours to extract THF-soluble matter. Subsequently, the centrifugation vial was set in a centrifuge "himac CR22G" (manufactured by Hitachi Koki Co., Ltd.) and centrifuged at a temperature of 20° C. at a rate of 15,000 rotations per minute for one hour to completely precipitate THF-insoluble matter of the whole organic-inorganic composite fine particle. The centrifugation vial was taken out and the THF-soluble matter extract was separated and removed. Thereafter, the centrifugation vial having a content therein was subjected to vacuum dry at 40° C. for 8 hours. The centrifugation vial was weighed, from which the mass of the centrifugation vial previously weighed was subtracted to obtain the mass (Wr [g]) of THF-insoluble matter of the whole organic-inorganic composite fine particle.

The THF-insoluble matter [mass %] of the resin of an organic-inorganic composite fine particle was calculated according to the following expression, provided that the inorganic fine particle content in the organic-inorganic composite fine particle was represented by Wi [mass %].

$$\text{THF-insoluble matter [mass \%] of the resin of an organic-inorganic composite fine particle} = \{(Wr - Wc \times Wi)/Wc \times (100 - Wi)\} \times 100$$

<Measurement Method of THF-Insoluble Matter of Resin in Organic Particle>

The THF-insoluble matter of a resin in an organic particle was obtained in the same manner as in the measurement method of THF-insoluble matter of a resin in the organic-inorganic composite fine particles. Since the organic particle does not contain an inorganic fine particle, calculation was made provided that Wi was 0.

In the case where THF-insoluble matter of a resin in an organic-inorganic composite fine particle is measured from a toner containing an external additive, the external additive is isolated from the toner and then measurement can be made. The toner is added to ion exchange water and ultrasonically dispersed to remove the external additive. The solution is allowed to stand still for 24 hours. The supernatant is collected and dried to isolate the external additive. In the case where a plurality of external additives are added to a toner, the supernatant is centrifugally separated to isolate the external additives and then measurement can be made.

<Method for Determining Coverage of the Surface of Organic-Inorganic Composite Fine Particle with Inorganic Fine Particle>

In the present invention, the coverage of the surface of an organic-inorganic composite fine particle with an inorganic fine particle is determined by ESCA (X-ray photoelectron spectrometry). If the inorganic particle present in the surface of an organic-inorganic composite fine particle is formed of silica, calculation can be made based on the atomic weight of silicon (hereinafter abbreviated to Si) derived from silica. ESCA is an analytical method for detecting atoms present in a surface of a sample up to a depth of several nm or less. Thus, the atoms present in the surface of an organic-inorganic composite fine particle can be detected.

As a sample holder, a 75-mm square platen (having a screw hole of about 1 mm in diameter for fixing a sample) attached to an apparatus was used. Since the screw hole of the platen is a through hole, the hole is stopped up with a resin, etc. to form a depression of about 0.5 mm in depth for powder measurement. The depression is charged with a measuring powder by e.g., a spatula and the powder is leveled to prepare a sample.

The ESCA apparatus and measurement conditions are as follows:

Apparatus used: Quantum 2000 manufactured by ULVAC-PHI, Inc.

Analyze method: Narrow analysis

Measurement Conditions:

X-ray source: Al-Kα

X-ray conditions: 100 μm, 25 W, 15 kV

Photoelectron collection angle: 45°

PassEnergy: 58.70 eV

Measurement range: ϕ100 μm

Measurement is performed under the following conditions.

In the analysis method, first a peak derived from a C—C bond of the carbon 1s orbit is corrected to 285 eV. Thereafter, the amount of Si derived from silica relative to the total amount of constitutional elements is calculated from a peak area (a peak top is detected at 100 eV or more and 105 eV or less) derived from the silicon 2p orbit by use of a relative-sensitivity factor provided by ULVAC-PHI, Inc.

First, an organic-inorganic composite fine particle is subjected to measurement. The particle of the inorganic component used in producing the organic-inorganic composite fine particle is subjected to the same measurement. If the inorganic component is silica, the ratio of the Si amount obtained by measurement of the organic-inorganic composite fine particle relative to the Si amount obtained by measurement of the silica particle is regarded as a presence ratio of the inorganic fine particle in the surface of the organic-inorganic composite fine particle in the present invention. In this measurement, calculation was made by using a sol-gel silica particle (number average particle diameter: 110 nm) described in Production Example as the silica particle.

If it is difficult to directly analyze coverage of surface of an organic-inorganic composite fine particle with an inorganic fine particle from the toner of the present invention, the organic-inorganic composite fine particle can be isolated from the toner of the present invention and then subjected to measurement.

A toner is ultrasonically dispersed in ion exchange water to remove an external additive and allowed to stand still for 24 hours. The supernatant is collected and dried to isolate the external additive. If a plurality of external additives are added to a toner, measurement can be made by isolating individual external additives by centrifugal separation of the supernatant.

Note that if the external additive is silica alone, the presence ratio of silica is 100%; whereas, if a surface treatment is not particularly made, the presence ratio of silica in the resin particle is 0%.

<Measurement Method of Shape Factor SF-2 of Organic-Inorganic Composite Fine Particle>

Shape factor SF-2 of an organic-inorganic composite fine particle was calculated by observing the organic-inorganic composite fine particle under a transmission electron microscope (TEM) "JEM-2800" (manufactured by JEOL) as follows.

Magnification for observation was appropriately adjusted depending upon the size of an organic-inorganic composite fine particle. Using image processing software, "Image-Pro Plus5.1J" (manufactured by Media Cybernetics), the perimeters and areas of 100 primary particles were computationally obtained under the viewing field magnified 200,000 times. Shape factor SF-2 was calculated according to the following expression and an average value thereof is regarded as shape factor SF-2 of the organic-inorganic composite fine particle.

$$\text{SF-2}=(\text{perimeter of particle})^2/\text{area of particle}\times 100/4\pi$$

Examples

Now, the present invention will be more specifically described by way of Examples and Comparative Examples below. However, the present invention is not particularly limited by these. The term "parts" described in Examples and Comparative Examples refers to parts by mass, unless otherwise specified.

<Production Example of Magnetic Iron Oxide Particle 1>

To an aqueous ferrous sulfate solution, a caustic soda solution (1.1 equivalent relative to an iron element) was mixed to prepare an aqueous solution containing ferrous hydroxide. The pH of the aqueous solution was adjusted to 8.0 and an oxidation reaction was performed at 85° C. while aerating to prepare a slurry liquid having a seed crystal.

Subsequently, to the slurry liquid, the aqueous ferrous sulfate solution was added so as to have 1.0 equivalent relative to the initial alkali amount (sodium component of caustic soda). Thereafter, an oxidation reaction was performed while maintaining the pH of the slurry liquid at 12.8 and aerating to obtain a slurry liquid containing magnetic iron oxide. The slurry liquid was filtered, washed, dried and ground to obtain magnetic iron oxide particle 1 of an octahedral structure having a primary-particle number average particle diameter (D1) of 0.20 μm, and an intensity of magnetization of 65.9 $Am^2/kg$ and a residual magnetization of 7.3 $Am^2/kg$ at a magnetic field of 79.6 kA/m (1000 oersted). The physical properties of magnetic iron oxide particle 1 are shown in Table 1.

<Production Example of Magnetic Iron Oxide Particle 2>

To an aqueous ferrous sulfate solution, a caustic soda solution (1.1 equivalent relative to an iron element) and $SiO_2$ (1.20% by mass in terms of silicon element relative to iron element) were mixed to prepare an aqueous solution containing ferrous hydroxide. The pH of the aqueous solution was maintained at 8.0 and an oxidation reaction was performed at 85° C. while aerating to prepare a slurry liquid containing a seed crystal.

Subsequently, to the slurry liquid, the aqueous ferrous sulfate solution was added so as to have 1.0 equivalent relative to the initial alkali amount (sodium component of caustic soda). Thereafter, an oxidation reaction was performed while maintaining the pH of the slurry liquid at 8.5 and aerating to obtain a slurry liquid containing magnetic iron oxide. The slurry liquid was filtered, washed, dried and ground to obtain spherical magnetic iron oxide particle 2 having a primary-particle number average particle diameter (D1) of 0.22 μm, an intensity of magnetization of 66.1 $Am^2/kg$ and a residual magnetization of 5.9 $Am^2/kg$ at a magnetic field of 79.6 kA/m (1000 oersted). The physical properties of magnetic iron oxide particle 2 are shown in Table 1.

<Production Examples of Magnetic Iron Oxide Particles 3 to 6>

Magnetic iron oxide particles 3 to 6 having a primary-particle number average particle diameter (D1) of 0.14 μm, 0.30 μm, 0.07 μm and 0.35 μm, respectively were obtained by changing the amount of aeration, reaction temperature and reaction time in the Production Example of magnetic iron oxide particle 2. The physical properties of magnetic iron oxide particles 3 to 6 are shown in Table 1.

TABLE 1

| | Shape | Primary-particle number average particle diameter [μm] | Intensity of magnetization [$Am^2/kg$] | Residual magnetization [$Am^2/kg$] | Coercive force [kA/m] |
|---|---|---|---|---|---|
| Magnetic iron oxide particle 1 | Octahedron | 0.20 | 65.9 | 7.3 | 20.0 |
| Magnetic iron oxide particle 2 | Sphere | 0.22 | 66.1 | 5.9 | 10.1 |
| Magnetic iron oxide particle 3 | Sphere | 0.14 | 64.2 | 7.9 | 11.5 |
| Magnetic iron oxide particle 4 | Sphere | 0.30 | 66.5 | 4.0 | 9.5 |
| Magnetic iron oxide particle 5 | Sphere | 0.07 | 62.0 | 10.0 | 15.3 |
| Magnetic iron oxide particle 6 | Sphere | 0.35 | 67.0 | 4.0 | 9.0 |

<Organic-Inorganic Composite Fine Particles C-1 to 8>

Organic-inorganic composite fine particles can be produced according to the description of Examples of WO2013/063291.

As the organic-inorganic composite fine particles to be used in Examples (described later), i.e., organic-inorganic composite fine particles 1 to 7, were produced according to the description of Example 1 of WO 2013/063291. Organic-inorganic composite fine particle C-8 was produced according to Production Example of a composite particle described in Japanese Patent Application Laid-Open No. 2005-202131. The physical properties of organic-inorganic composite fine particles C-1 to 8 are shown in Table 2.

TABLE 2

| Organic-inorganic composite fine particles | Number average diameter (nm) | SF-2 | Coverage of surface of organic-inorganic composite fine particle with inorganic fine particle (%) | THF-insoluble matter (%) |
|---|---|---|---|---|
| C-1 | 106 | 115 | 65 | 98 |
| C-2 | 99 | 103 | 42 | 97 |
| C-3 | 159 | 117 | 48 | 96 |
| C-4 | 72 | 104 | 58 | 98 |
| C-5 | 335 | 106 | 59 | 99 |
| C-6 | 190 | 118 | 50 | 98 |
| C-7 | 150 | 110 | 70 | 75 |
| C-8 | 120 | 105 | 50 | 93 |

<Other Additives>

In the toner Production Examples (described later), as the additives to be used other than the organic-inorganic composite fine particles, Eposter series manufactured by NIPPON SHOKUBAI CO., LTD were used as resin fine particles and SEAHOSTAR series manufactured by NIPPON SHOKUBAI CO., LTD were used as colloidal silica (inorganic particles).

<Production of Magnetic Toner Particle 1>

| | |
|---|---|
| Styrene n-butyl acrylate copolymer 1: (mass ratio of styrene and n-butyl acrylate: 78:22; glass transition temperature (Tg): 58° C., peak molecular weight: 8500) | 100.0 parts |
| Magnetic substance (magnetic iron oxide particle 1): | 95.0 parts |
| Polyethylene wax: (melting point 102° C.) | 5.0 parts |
| Iron complex of mono-azo dye (T-77: manufactured by Hodogaya Chemical Co., Ltd.) | 1.8 parts |

The raw materials shown above were preparatorily mixed by a Henschel mixer FM10C (NIPPON COKE & ENGINEERING Co., Ltd.). The raw materials were then kneaded by a twin screw kneading extruder (PCM-30: manufactured by Ikegai Tekkosho) at a rotation number of 250 rpm while adjusting the temperature such that the temperature of a kneaded product near the outlet became 145° C.

The melt-kneaded product obtained was cooled and roughly ground by a cutter mill. The ground product obtained was finely ground by a turbo mill T-250 (manufactured by Turbo Kogyou) in a feed amount of 25 kg/hr while adjusting air temperature so as to obtain an exhaust temperature of 38° C. The micro-ground product was classified by a multifraction classifier using the Coanda effect to obtain magnetic toner particle 1 having a weight average particle diameter (D4) of 8.2 μm.

Production Example of Magnetic Toner 1

To magnetic toner particle 1, external additives was added by using the apparatus shown in FIG. 1.

Figure 2:
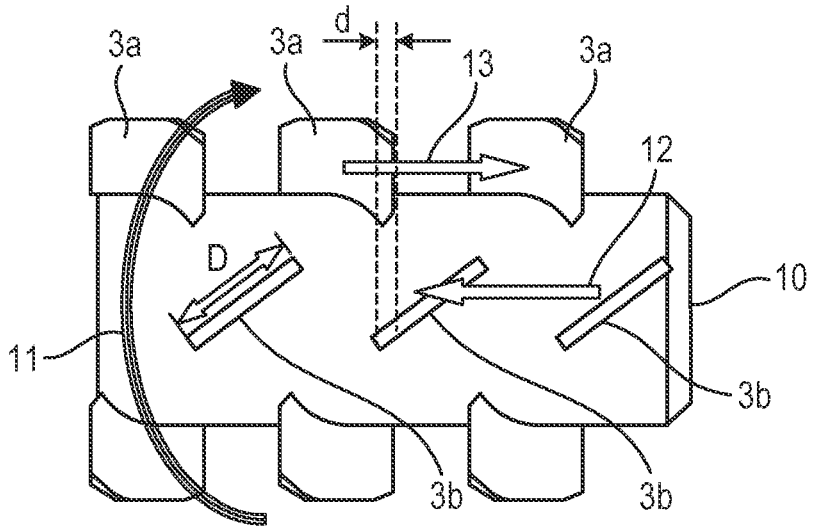
FIG. 2 is a schematic view of the structure of a stirring member used in a mixing apparatus.

In this Example, the apparatus shown in FIG. 1 (the inner periphery diameter of main-body casing 1: 130 mm, the volume of a treatment space 9: $2.0\times10^{-3}$ $m^3$) was used. The rated power of a driving portion 8 was set at 5.5 kW. The shape of a stirring member 3 as shown in FIG. 2 was used. In FIG. 2, the width d of overlapped portion of a stirring member 3*a* with a stirring member 3*b* was set at 0.25D where D represents a maximum width of the stirring member 3, and the clearance between the stirring member 3 and the inner circumference of the main body casing 1 was set at 3.0 mm.

To the apparatus shown in FIG. 1 having the aforementioned constitution, all of the magnetic toner particle 1 (100 parts) and additives shown in Table 3 were placed.

Silica fine particle 1 was obtained by treating 100 parts of silica (primary-particle number average particle diameter (D1): 16 nm, BET: 130 $m^2/g$) with hexamethyldisilazane (10 parts) and subsequently with dimethyl silicone oil (10 parts).

After the addition and before an external additive treatment, a premixing was performed in order to homogeneously mix the toner particles and the additives. The conditions for premix are as follows: power for driving portion 8: 0.1 W/g (rotation number of a driving portion 8: 150 rpm); and treatment time: 1 minute.

After completion of the premix, external additives were mixed. As conditions for an external additive mixing treatment, the circumferential speed of the outmost part of the stirring member 3 was adjusted so as to provide a constant power (the driving portion 8) of 1.0 W/g (rotation number of the driving portion 8: 1800 rpm), and a treatment was performed for 5 minutes. The conditions for the external additive mixing treatment are shown in Table 3.

After the external additive mixing treatment, rough particles and others were removed by a circular vibration sieve provided with a screen having a diameter of 500 mm and a sieve opening of 75 μm to obtain magnetic toner 1. Magnetic toner 1 was observed by a scanning electron microscope. Using a magnified view of magnetic toner 1, the primary-particle number average particle diameter of silica fine particles on the magnetic-toner surface was determined, it was 18 nm. The conditions for an external additive mixing treatment of magnetic toner 1 are shown in Table 3 and the physical properties of magnetism toner 1 are shown in Table 4.

TABLE 3

| | External additive | | | | | | | | | | | | | | | | |
|---|---|---|---|---|---|---|---|---|---|---|---|---|---|---|---|---|---|
| | Addition amount to toner particle (100 parts by mass) | | | | | | | | Content (mass %) based on toner particle (by mass) | | | | | | External addition condition | | |
| | Organic-inorganic composite fine particle | | Inorganic fine particle a | | | | Magnetic iron oxide particle | | Organic-inorganic composite fine particle | Inorganic fine particle a | | | presence ratio of silica fine particle (mass %) | Magnetic iron oxide particle | | | |
| | | | Silica fine particle | | Titania fine particle | Alumina fine particle | | | | Silica fine particle | Titania fine particle | Alumina fine particle | | | | | |
| Toner No. | Type | Addition amount | Type | Addition amount | | | Type | Addition amount | | | | | | | Apparatus | Operation condition | Operation time |
| Magnetic toner 1 | C-1 | 1.0 | 1 | 2.00 | — | — | 1 | 0.5 | 0.99 | 1.98 | — | — | 100 | 0.49 | Apparatus of FIG. 1 | 1.0 W/g (1800 rpm) | 5 min |
| Magnetic toner 2 | C-1 | 1.0 | 1 | 2.00 | — | — | 1 | 0.2 | 0.98 | 1.97 | — | — | 100 | 0.19 | Apparatus of FIG. 1 | 1.0 W/g (1800 rpm) | 5 min |
| Magnetic toner 3 | C-1 | 1.0 | 1 | 2.00 | — | — | 1 | 4.8 | 0.99 | 1.98 | — | — | 100 | 4.77 | Apparatus of FIG. 1 | 1.0 W/g (1800 rpm) | 5 min |
| Magnetic toner 4 | C-2 | 1.0 | 1 | 2.00 | — | — | 1 | 0.5 | 0.98 | 1.98 | — | — | 100 | 0.48 | Apparatus of FIG. 1 | 1.0 W/g (1800 rpm) | 5 min |
| Magnetic toner 5 | C-3 | 2.0 | 1 | 2.00 | — | — | 1 | 0.5 | 1.98 | 1.98 | — | — | 100 | 0.47 | Apparatus of FIG. 1 | 1.0 W/g (1800 rpm) | 5 min |
| Magnetic toner 6 | C-4 | 0.6 | 1 | 2.00 | — | — | 1 | 0.5 | 0.59 | 1.97 | — | — | 100 | 0.48 | Apparatus of FIG. 1 | 1.0 W/g (1800 rpm) | 5 min |
| Magnetic toner 7 | C-5 | 2.2 | 1 | 2.00 | — | — | 1 | 0.5 | 2.18 | 1.98 | — | — | 100 | 0.48 | Apparatus of FIG. 1 | 1.0 W/g (1800 rpm) | 5 min |
| Magnetic toner 8 | C-1 | 0.1 | 1 | 2.00 | — | — | 1 | 0.5 | 0.09 | 1.98 | — | — | 100 | 0.48 | Apparatus of FIG. 1 | 1.0 W/g (1800 rpm) | 5 min |
| Magnetic toner 9 | C-1 | 5.5 | 1 | 2.00 | — | — | 1 | 0.5 | 5.48 | 1.98 | — | — | 100 | 0.47 | Apparatus of FIG. 1 | 1.0 W/g (1800 rpm) | 5 min |
| Magnetic toner 10 | C-7 | 2.0 | 1 | 2.00 | — | — | 1 | 0.5 | 1.98 | 1.98 | — | — | 100 | 0.48 | Apparatus of FIG. 1 | 1.0 W/g (1800 rpm) | 5 min |
| Magnetic toner 11 | C-6 | 2.0 | 1 | 2.00 | — | — | 1 | 0.5 | 1.97 | 1.97 | — | — | 100 | 0.48 | Apparatus of FIG. 1 | 1.0 W/g (1800 rpm) | 5 min |
| Magnetic toner 12 | C-1 | 1.0 | 1 | 2.00 | — | — | 2 | 0.5 | 0.97 | 1.98 | — | — | 100 | 0.47 | Apparatus of FIG. 1 | 1.0 W/g (1800 rpm) | 5 min |
| Magnetic toner 13 | C-1 | 1.0 | 1 | 2.00 | — | — | 3 | 0.5 | 0.98 | 1.97 | — | — | 100 | 0.48 | Apparatus of FIG. 1 | 1.0 W/g (1800 rpm) | 5 min |
| Magnetic toner 14 | C-1 | 1.0 | 1 | 2.00 | — | — | 4 | 0.5 | 0.98 | 1.97 | — | — | 100 | 0.48 | Apparatus of FIG. 1 | 1.0 W/g (1800 rpm) | 5 min |
| Magnetic toner 15 | C-1 | 1.0 | 1 | 2.00 | — | — | 5 | 0.5 | 0.98 | 1.98 | — | — | 100 | 0.47 | Apparatus of FIG. 1 | 1.0 W/g (1800 rpm) | 5 min |
| Magnetic toner 16 | C-1 | 1.0 | 1 | 2.00 | — | — | 6 | 0.5 | 0.98 | 1.98 | — | — | 100 | 0.48 | Apparatus of FIG. 1 | 1.0 W/g (1800 rpm) | 5 min |
| Magnetic toner 17 | C-1 | 1.0 | 1 | 1.50 | — | — | 1 | 0.5 | 0.97 | 1.47 | — | — | 100 | 0.48 | Apparatus of FIG. 1 | 1.0 W/g (1800 rpm) | 5 min |
| Magnetic toner 18 | C-1 | 1.0 | 1 | 1.70 | — | — | 1 | 0.5 | 0.98 | 1.68 | — | — | 100 | 0.47 | Apparatus of FIG. 1 | 1.0 W/g (1800 rpm) | 5 min |

TABLE 3-continued

| | External additive | | | | | | | | | | | | | | | | |
|---|---|---|---|---|---|---|---|---|---|---|---|---|---|---|---|---|---|
| | Addition amount to toner particle (100 parts by mass) | | | | | | | | Content (mass %) based on toner particle (by mass) | | | | | | External addition condition | | |
| | Organic-inorganic composite fine particle | | Inorganic fine particle a: Silica fine particle | | Titania fine particle | Alumina fine particle | Magnetic iron oxide particle | | Organic-inorganic composite fine particle | Inorganic fine particle a: Silica fine particle | Titania fine particle | Alumina fine particle | presence ratio of silica fine particle (mass %) | Magnetic iron oxide particle | | | |
| Toner No. | Type | Addition amount | Type | Addition amount | | | Type | Addition amount | | | | | | | Apparatus | Operation condition | Operation time |
| Magnetic toner 19 | C-1 | 1.0 | 1 | 2.30 | — | — | 1 | 0.5 | 0.97 | 2.27 | — | — | 100 | 0.48 | Apparatus of FIG. 1 | 1.0 W/g (1800 rpm) | 5 min |
| Magnetic toner 20 | C-1 | 1.0 | 1 | 2.20 | — | — | 1 | 0.5 | 0.98 | 2.18 | — | — | 100 | 0.48 | Apparatus of FIG. 1 | 1.0 W/g (1800 rpm) | 5 min |
| Magnetic toner 21 | C-1 | 1.0 | 1 | 1.80 | — | — | 1 | 0.5 | 0.97 | 1.78 | — | — | 100 | 0.47 | Henschel mixer | 4000 rpm | 3 min |
| Magnetic toner 22 | C-1 | 1.0 | 1 | 1.80 | — | — | 1 | 0.5 | 0.98 | 1.77 | — | — | 100 | 0.47 | Hybridizer | 6000 rpm | 5 min |
| Magnetic toner 23 | C-1 | 1.0 | 1 | 2.00 | 0.20 | — | 1 | 0.5 | 0.98 | 1.97 | 0.19 | — | 91 | 0.48 | Apparatus of FIG. 1 | 1.0 W/g (1800 rpm) | 5 min |
| Magnetic toner 24 | C-1 | 1.0 | 1 | 2.00 | — | 0.30 | 1 | 0.5 | 0.97 | 1.98 | — | 0.29 | 87 | 0.48 | Apparatus of FIG. 1 | 1.0 W/g (1800 rpm) | 5 min |
| Comparative magnetic toner 1 | C-1 | 1.0 | 1 | 2.00 | — | — | 1 | 0.01 | 0.97 | 1.98 | — | — | 100 | 0.009 | Apparatus of FIG. 1 | 1.0 W/g (1800 rpm) | 5 min |
| Comparative magnetic toner 2 | C-1 | 1.0 | 1 | 2.00 | — | — | 1 | 5.6 | 0.97 | 1.97 | — | — | 100 | 5.57 | Apparatus of FIG. 1 | 1.0 W/g (1800 rpm) | 5 min |
| Comparative magnetic toner 3 | — | — | 1 | 2.00 | — | — | 1 | 0.5 | — | 1.98 | — | — | 100 | 0.47 | Apparatus of FIG. 1 | 1.0 W/g (1800 rpm) | 5 min |
| Comparative magnetic toner 4 | C-8 | 1.0 | 1 | 2.00 | — | — | — | — | 0.97 | 1.97 | — | — | 100 | — | Apparatus of FIG. 1 | 1.0 W/g (1800 rpm) | 5 min |
| Comparative magnetic toner 5 | (Colloidal silica) | 1.0 | 1 | 2.00 | — | — | Magnetic iron oxide particle 1 | 0.5 | — | 2.98 (*1) | — | — | 100 | 0.47 | Apparatus of FIG. 1 | 1.0 W/g (1800 rpm) | 5 min |
| Comparative magnetic toner 6 | (Resin fine particle) | 1.0 | 1 | 2.00 | — | — | Magnetic iron oxide particle 1 | 0.5 | (0.97) | 1.98 | — | — | 100 | 0.48 | Apparatus of FIG. 1 | 1.0 W/g (1800 rpm) | 5 min |

(*1): Total amount of colloidal silica and silica fine particle 1

TABLE 4

| | Coverage A (%) | B/A (—) | Variation coefficient (—) |
|---|---|---|---|
| Magnetic toner 1 | 55.5 | 0.68 | 6.5 |
| Magnetic toner 2 | 55.0 | 0.69 | 6.6 |
| Magnetic toner 3 | 55.3 | 0.65 | 6.3 |
| Magnetic toner 4 | 55.5 | 0.68 | 6.5 |
| Magnetic toner 5 | 55.5 | 0.68 | 6.5 |
| Magnetic toner 6 | 55.5 | 0.68 | 6.5 |
| Magnetic toner 7 | 55.5 | 0.68 | 6.5 |
| Magnetic toner 8 | 55.5 | 0.68 | 6.5 |
| Magnetic toner 9 | 55.5 | 0.68 | 6.5 |
| Magnetic toner 10 | 55.5 | 0.68 | 6.5 |
| Magnetic toner 11 | 55.5 | 0.68 | 6.5 |
| Magnetic toner 12 | 55.5 | 0.68 | 6.5 |
| Magnetic toner 13 | 55.0 | 0.66 | 6.3 |
| Magnetic toner 14 | 55.8 | 0.60 | 6.4 |
| Magnetic toner 15 | 54.8 | 0.59 | 6.3 |
| Magnetic toner 16 | 55.3 | 0.56 | 6.7 |
| Magnetic toner 17 | 38.0 | 0.71 | 6.5 |
| Magnetic toner 18 | 45.0 | 0.68 | 6.6 |
| Magnetic toner 19 | 77.0 | 0.66 | 6.8 |
| Magnetic toner 20 | 70.0 | 0.63 | 6.4 |
| Magnetic toner 21 | 50.0 | 0.42 | 16.0 |
| Magnetic toner 22 | 50.0 | 0.87 | 12.0 |
| Magnetic toner 23 | 55.0 | 0.66 | 6.3 |
| Magnetic toner 24 | 55.0 | 0.67 | 6.7 |
| Comparative magnetic toner 1 | 55.5 | 0.60 | 6.5 |
| Comparative magnetic toner 2 | 55.4 | 0.63 | 6.5 |
| Comparative magnetic toner 3 | 57.0 | 0.63 | 7.0 |
| Comparative magnetic toner 4 | 56.0 | 0.64 | 8.1 |
| Comparative magnetic toner 5 | 55.1 | 0.65 | 8.0 |
| Comparative magnetic toner 6 | 55.2 | 0.65 | 8.1 |

Example 1

(Evaluation of Initial Density after being Left Alone in a High Temperature/Humidity Environment)

The initial density after a toner of the present invention was left alone in a high temperature/humidity environment was evaluated as follows.

A laser beam printer: HP LaserJet M455 manufactured by Hewlett-Packard Company, was modified such that fixation temperature can be adjusted and process speed can be arbitrarily set. Using the above apparatus, a process speed was set at 370 mm/sec and a fixing temperature was fixed to 210° C.

A process cartridge of the aforementioned printer was charged with the toner. Subsequently, both the main body and cartridge of the printer were left alone in a high temperature/humidity (30.0° C., 80.0% RH) environment for 48 hours. A lateral-line pattern (a printing ratio of 5%) was printed on two sheets (A4 size, 81.4 g/m$^2$) per job and continuously printed on 10 paper sheets, and thereafter, a solid image (a printing ratio of 100%) was printed on a single paper sheet and image density was measured. Evaluation of images was made under a normal-temperature normal-humidity environment (23.0° C., 50% RH). The image density was measured by determining the reflection density of a 5-mm circular solid image by a reflection densitometer, i.e., Macbeth densitometer (manufactured by Macbeth) using an SPI filter. The evaluation results are shown in Table 5.

A: Reflection density of 10th paper sheet is 1.4 or more

B: Reflection density of 10th paper sheet is 1.3 or more and less than 1.4.

C: Reflection density of 10th paper sheet is 1.2 or more and less than 1.3.

D: Reflection density of 10th paper sheet is less than 1.2.

(Evaluation of Long-Term Stability in a High Temperature/Humidity Environment)

Long-term stability of the toner of the present invention in a high temperature/humidity environment was evaluated as follows.

A process cartridge of the aforementioned printer was charged with the toner. After the cartridge was left alone in a high temperature/humidity (30.0° C., 80.0% RH) environment for 48 hours, a lateral-line pattern (a printing ratio of 5%) was printed on two sheets (A4 size paper of 81.4 g/m$^2$) per job and continuously printed on 5000 paper sheets, and thereafter, a solid image (a printing ratio of 100%) was printed on a single paper sheet and image density was measured. Evaluation was made under a normal-temperature normal-humidity environment (23.0° C., 50% RH). The image density was measured by determining the reflecting density of a 5-mm circular solid image by a reflecting densitometer, i.e., Macbeth densitometer (manufactured by Macbeth) using an SPI filter. The evaluation results are shown in Table 5.

A: Reflecting density of 1.4 or more is maintained before 5000 sheets.

B: Reflection density after 5000 sheets are printed is 1.3 or more and less than 1.4.

C: Reflection density after 5000 sheets are printed is 1.2 or more and less than 1.3.

D: Reflection density after 5000 sheets are printed is less than 1.2.

(Image Defect in the Latter Half of Durability Test (Evaluation of Effect of White Streak))

Image quality of the toner of the present invention in the latter half of a durability test was evaluated as follows.

A process cartridge of the aforementioned printer was charged with the toner. After the cartridge was left alone in a high temperature/humidity (30.0° C., 80.0% RH) environment for 48 hours, a lateral-line pattern (a printing ratio of 2%) was printed on two sheets (paper of 81.4 g/m$^2$) per job and continuously printed on 5000 paper sheets, and thereafter, a solid image (a printing ratio of 100%) was printed. The reducing effect of the occurrence of a white streak on image density was evaluated. Evaluation was performed under a normal-temperature normal-humidity environment (23.0° C., 50% RH). Evaluation results are shown in Table 5.

A: After printing of 5000 paper sheets, the reflection density of the solid image is 1.4 or more.

B: After printing of 5000 paper sheets, the reflection density of the solid image is 1.3 or more and less than 1.4.

C: After printing of 5000 paper sheets, the reflection density of the solid image is 1.2 or more and less than 1.3.

D: After printing of 5000 paper sheets, the reflection density of the solid image is less than 1.2.

Examples 2 to 24

Toners 2 to 24 were produced in the same manner as in Example 1 according to the formulations shown in Table 3. The physical properties of individual toners are shown in Table 4 and the results of the test performed in the same manner as in Example 1 are shown in Table 5.

Comparative Examples 1 to 6

Comparative toners 1 to 6 were produced in the same manner as in Example 1 according to the formulations shown in Table 3. The physical properties of individual toners are shown in Table 4 and the results of the test performed in the same manner as in Example 1 are shown in Table 5.

TABLE 5

| | Initial density after standstill in high temperature/humidity environment | | Long-term stability | | Image defect (white streak) | |
|---|---|---|---|---|---|---|
| Example 1 | A | 1.44 | A | 1.44 | A | 1.44 |
| Example 2 | B | 1.38 | A | 1.38 | A | 1.42 |
| Example 3 | A | 1.42 | A | 1.41 | B | 1.38 |
| Example 4 | B | 1.37 | A | 1.41 | A | 1.42 |
| Example 5 | B | 1.37 | A | 1.41 | B | 1.36 |
| Example 6 | A | 1.42 | A | 1.41 | B | 1.35 |
| Example 7 | A | 1.42 | B | 1.39 | B | 1.36 |
| Example 8 | B | 1.36 | B | 1.36 | A | 1.41 |
| Example 9 | A | 1.42 | A | 1.41 | B | 1.34 |
| Example 10 | A | 1.42 | A | 1.41 | C | 1.28 |
| Example 11 | C | 1.28 | A | 1.41 | B | 1.35 |
| Example 12 | A | 1.42 | A | 1.42 | B | 1.34 |
| Example 13 | B | 1.36 | A | 1.41 | B | 1.36 |
| Example 14 | A | 1.42 | A | 1.41 | B | 1.36 |
| Example 15 | C | 1.28 | B | 1.32 | A | 1.40 |
| Example 16 | A | 1.42 | A | 1.41 | C | 1.22 |
| Example 17 | C | 1.28 | A | 1.41 | A | 1.41 |
| Example 18 | B | 1.36 | A | 1.42 | A | 1.42 |
| Example 19 | C | 1.27 | A | 1.42 | A | 1.41 |
| Example 20 | B | 1.35 | A | 1.41 | A | 1.42 |
| Example 21 | B | 1.35 | A | 1.42 | B | 1.33 |
| Example 22 | B | 1.34 | B | 1.33 | A | 1.42 |
| Example 23 | B | 1.34 | A | 1.40 | A | 1.41 |
| Example 24 | B | 1.35 | A | 1.41 | A | 1.40 |
| Comparative Example 1 | C | 1.24 | C | 1.24 | A | 1.40 |
| Comparative Example 2 | A | 1.41 | C | 1.25 | D | 1.11 |
| Comparative Example 3 | C | 1.25 | C | 1.24 | A | 1.40 |
| Comparative Example 4 | D | 1.18 | C | 1.24 | A | 1.40 |
| Comparative Example 5 | C | 1.22 | C | 1.23 | B | 1.32 |
| Comparative Example 6 | C | 1.22 | C | 1.22 | B | 1.32 |

REFERENCE SIGNS LIST

1: main-body casing, 2: rotating body, 3, 3*a*, 3*b*: stirring member, 4: jacket, 5: raw material feed port, 6: Product ejection port, 7: center axis, 8: driving portion, 9: treatment space, 10: rotating body end parts side surface, 11: rotation direction, 12: backward direction, 13: feed direction, 16: inner piece for a raw material feed port, 17: inner piece for product ejection port, d: width of overlapped portion of stirring members, D: width of a stirring member While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-158909, filed Jul. 31, 2013, which is hereby incorporated by reference herein in its entirety.

The invention claimed is:

1. A toner comprising:

a toner particle containing a binder resin and a colorant;

an iron oxide particle;

an inorganic fine particle "a" selected from the group consisting of a silica particle, a titanium oxide particle and an alumina particle; and an organic-inorganic composite fine particle, the organic-inorganic composite fine particle comprising a vinyl resin particle and inorganic fine particles "b" which are embedded in the vinyl resin particle, at least a part of said inorganic fine particles "b" being exposed at surface of the organic-inorganic composite fine particle, wherein the organic-inorganic composite fine particle has convexes derived from the inorganic fine particles, a coverage ratio A of the toner particle surface with the inorganic fine particle "a" is 45.0 to 70.0%, a ratio of a coverage ratio B to coverage ratio A is 0.50 to 0.85, when coverage ratio B (%) is a coverage ratio of the inorganic fine particle "a" adhered to the toner particle surface, a coverage ratio C of the surface of the organic-inorganic composite fine particle with the inorganic fine particles "b" is 20 to 70%, and the content of the iron oxide particle present on a surface of the toner particle is 0.1 to 5.0% by mass based on the mass of the toner particle.

2. The toner according to claim 1, wherein the organic-inorganic composite fine particle is contained in the toner in an amount of 0.2 to 5.0% by mass.

3. The toner according to claim 1, wherein a shape factor SF-2 is 103 to 120 measured using a photograph of an image of the organic-inorganic composite fine particle magnified 200,000 times by a scanning electron microscope, and a number average particle diameter of the organic-inorganic composite fine particle is 70 to 500 nm.

4. The toner according to claim 1, wherein the coverage ratio C is 40 to 70%.

5. The toner according to claim 1, wherein THF-insoluble matter of a resin of the organic-inorganic composite fine particle is 95% or more.

6. The toner according to claim 1, wherein a primary particle of the inorganic fine particle "a" has a number average particle diameter (D1) of 5 to 25 nm.

7. The toner according to claim 1, wherein a primary particle of the iron oxide particle has a number average particle diameter of 0.05 to 0.5 μm.

8. The toner according to claim 1, wherein a primary particle of the inorganic fine particle "a" has a number average particle diameter (D1) of 5 to 25 nm, and a primary particle of the iron-oxide particle has a number average particle diameter of 0.05 to 0.5 μm.

* * * * *